US010203620B2

(12) United States Patent
Naito et al.

(10) Patent No.: US 10,203,620 B2
(45) Date of Patent: Feb. 12, 2019

(54) TONER, IMAGE FORMING METHOD, AND PROCESS CARTRIDGE

(71) Applicants: Yu Naito, Shizuoka (JP); Kazumi Suzuki, Shizuoka (JP); Yoshitaka Yamauchi, Shizuoka (JP); Masashi Nagayama, Shizuoka (JP); Hisashi Nakajima, Shizuoka (JP); Saori Yamada, Shizuoka (JP)

(72) Inventors: Yu Naito, Shizuoka (JP); Kazumi Suzuki, Shizuoka (JP); Yoshitaka Yamauchi, Shizuoka (JP); Masashi Nagayama, Shizuoka (JP); Hisashi Nakajima, Shizuoka (JP); Saori Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 1098 days.

(21) Appl. No.: 14/333,800

(22) Filed: Jul. 17, 2014

(65) Prior Publication Data

US 2015/0030819 A1 Jan. 29, 2015

(30) Foreign Application Priority Data

Jul. 26, 2013 (JP) ..... 2013-155469
May 1, 2014 (JP) ..... 2014-094448

(51) Int. Cl.
*G03G 9/087* (2006.01)
*G03G 9/09* (2006.01)
*G03G 9/097* (2006.01)

(52) U.S. Cl.
CPC ..... *G03G 9/08755* (2013.01); *G03G 9/08782* (2013.01); *G03G 9/08795* (2013.01);
(Continued)

(58) Field of Classification Search
CPC ..... G03G 9/087
See application file for complete search history.

(56) References Cited

U.S. PATENT DOCUMENTS 5,853,943 A * 12/1998 Cheng ..... C08F 2/26 430/137.14
6,381,431 B1 * 4/2002 Kinoshita ..... G03G 15/0241 399/175

(Continued)

FOREIGN PATENT DOCUMENTS

CN 100409107 C 8/2008
CN 101782726 A 7/2010

(Continued)

OTHER PUBLICATIONS

Office Action dated Sep. 30, 2017, in Chinese Patent Application No. 201410360283.0.

(Continued)

*Primary Examiner* — Gerard Higgins
*Assistant Examiner* — Sathavaram I Reddy
(74) *Attorney, Agent, or Firm* — Oblon, McClelland, Maier & Neustadt, L.L.P.

(57) ABSTRACT

Toner contains a binder resin, a releasing agent, and a tri- or higher metal salt, wherein the toner has a weight average molecular weight (Mw) of from 7,000 to 10,000, a ratio of the weight average molecular weight (Mw) to a number average molecular weight (Mn) of 5 or less, and an acid value of from 6 mgKOH/g to 12 mgKOH/g, wherein the binder resin is a polyester resin, wherein the releasing agent is a monoester wax.

6 Claims, 8 Drawing Sheets

(52) U.S. Cl.
CPC ..... *G03G 9/08797* (2013.01); *G03G 9/09* (2013.01); *G03G 9/09791* (2013.01); *G03G 2221/183* (2013.01); *Y10T 428/24802* (2015.01)

(56) References Cited

U.S. PATENT DOCUMENTS

| | | | | |
|---|---|---|---|---|
| 6,413,692 | B1 * | 7/2002 | Cheng | G03G 9/0806 430/137.14 |
| 2003/0129517 | A1 * | 7/2003 | Hotta | G03G 9/0821 430/108.22 |
| 2003/0180647 | A1 * | 9/2003 | Patel | G03G 9/0804 430/137.14 |
| 2008/0225312 | A1 * | 9/2008 | Ogawa | H04N 1/54 358/1.9 |
| 2009/0202934 | A1 | 8/2009 | Hasegawa | |
| 2009/0233199 | A1 | 9/2009 | Nozaki et al. | |
| 2010/0183968 | A1 * | 7/2010 | Sugawara | G03G 9/08782 430/108.1 |
| 2011/0081608 | A1 | 4/2011 | Yaguchi et al. | |
| 2011/0294058 | A1 | 12/2011 | Shiba et al. | |
| 2013/0252160 | A1 | 9/2013 | Nagayama et al. | |

FOREIGN PATENT DOCUMENTS

| | | | |
|---|---|---|---|
| CN | 102262365 | A | 11/2011 |
| CN | 103048897 | A | 4/2013 |
| JP | 8-220821 | | 8/1996 |
| JP | 9-325520 | A | 12/1997 |
| JP | 2000-356925 | | 12/2000 |
| JP | 2003-005432 | | 1/2003 |
| JP | 2007-078906 | | 3/2007 |
| JP | 2008-070523 | | 3/2008 |
| JP | 2009-217083 | | 9/2009 |
| JP | 2011-100106 | | 5/2011 |
| JP | 2012-214663 | A | 11/2012 |
| JP | 2013-15673 | A | 1/2013 |

OTHER PUBLICATIONS

Office Action dated Feb. 2, 2018 in Japanese Patent Application No. 2014-094448, 4 pages.

* cited by examiner

TONER, IMAGE FORMING METHOD, AND PROCESS CARTRIDGE

CROSS-REFERENCE TO RELATED APPLICATIONS

This patent application is based on and claims priority pursuant to 35 U.S.C. § 119 to Japanese Patent Application Nos. 2013-155469 and 2014-094448, on Jul. 26, 2013 and May 1, 2014, respectively, in the Japan Patent Office, the entire disclosures of which are hereby incorporated by reference herein.

BACKGROUND

Technical Field

The present invention relates to a toner, an image forming method, and a process cartridge.

Background Art

Electrography employed in image forming apparatuses such as laser printers and dry type electrostatic photocopiers includes the following steps:

1. Uniformly charging the surface of an image bearing member such as photoconductive layer;
2. Exposing the surface of the image bearing member to light to form an electric latent image by erasing charges on the exposed portion;
3. Rendering the latent image visible by attaching fine powder having charges such as toner to the latent image;
4. Transferring the obtained visible image to a recording medium such as a transfer sheet followed by application of heat and pressure to permanently fix the image thereon; and
5. Removing fine powder that has not been transferred but remained on the surface of the image bearing member.

To apply heat, a heating device such as a heat roll, an oven, and a flash is used.

Heating temperature is controlled by a thermostat or other sensors.

The image forming apparatus of late have been demanded to enjoy energy efficiency and high performance. Accordingly, toner is demanded to have properties of melting and fusing at low temperatures.

Although low temperature fixing is made possible by just lowering the melting point of toner, the storage stability of the toner becomes a concern.

In addition, demand for better image quality is strong. Specifically, clear and vivid gloss is demanded for high grade images such as photographs.

Furthermore, in the fixing method by heating as described above, to conduct fixing by heating by, for example, a heat roll, the surface temperature of the heat roll is controlled considering the characteristics of toner used. In such a case, the surface temperature of the heat roll changes depending on operation and suspension of the heat roll, the passing state of a recording medium, environment conditions, overshooting of the heat roll, etc. Therefore, high gloss is required to be achieved irrespective of the change of fixing temperature.

As methods of forming gloss images on the same recording medium in electrophotography, a method of controlling gloss by the number average molecular weight of a resin for use in toner is disclosed in JP-H8-220821-A, a method of improving releasability during fixing is disclosed in JP-2003-5432-A, and a method of controlling gloss by adjusting the viscoelasticity of transparent toner is disclosed in JP-2011-100106-A. In addition, JP-2009-217083-A discloses a method of imparting gloss by softening transparent gloss controlling particles during fixing to smooth the surface of an image.

As described above, there are various methods to control gloss on a recording medium. For example, JP-H8-220821-A mentioned above uses a polyester resin having a number average molecular weight of about 3,500 for a transparent toner and a polyester having a number average molecular weight of about 10,000 for a colored toner. The melting point of the transparent toner is lower than that of the colored toner, thereby increasing smoothness, so that the gloss of the portion of the transparent toner is partially improved.

However, the transparent toner is applied as the uppermost layer of an image so that it directly contacts a fixing device. Accordingly, the transparent toner is required to have a better hot offset resistance than the colored toner. Moreover, since the transparent toner is overlapped on the colored toner image, the toner layer becomes thick. Unless the colored toner has a good cold offset resistance, the results of such a combination of a transparent toner having a low melting point and a colored toner having a high melting point tends to be unstable.

To impart a good hot offset resistance to toner, a cross-linkable monomer is in general introduced into a resin to obtain a wide molecular weight distribution, thereby preventing occurrence of hot offset.

However, if such a cross-linkable monomer is introduced, hot offset can be prevented but fluidity is not demonstrated because of elastic components. As a result, the smoothness of the surface of toner is impaired, thereby lowering the gloss of an obtained image.

In addition, JP-2003-5432-A mentioned above discloses that a styrene-acrylic resin is used as a polyester resin to disperse a releasing agent in order that the releasing agent becomes a suitable size to demonstrate releasability, meaning that the adverse impact of the releasing agent contained in the toner is lessened. Furthermore, by using a particular acrylic resin for the polyester resin, decrease of the gloss of an image can be subdued.

However, spot high gloss close to photograph gloss obtained by spot varnish is not realized yet.

In addition, JP-2011-100106-A mentioned above discloses that high gloss can be demonstrated under the condition that the loss tangent (tan δ), which is represented by the ratio of loss elastic modulus (G") to storage elastic modulus (G'), has the maximum peak in the range of from 80° C. to 160° C. with a maximum peak value of 3 or more.

However, JP-2011-100106-A mentioned above does not mention whether the fixing temperature showing high gloss has a range.

Moreover, in the method disclosed in JP-2009-217083-A mentioned above, since the melting point of a material to soften a binder resin of the gloss control particles, the storage stability of toner is not sufficient.

SUMMARY

The present invention provides an improved toner is provided which contains a binder resin; a releasing agent; and a tri- or higher metal salt, wherein the toner has a weight average molecular weight (Mw) of from 7,000 to 10,000, a ratio of the weight average molecular weight (Mw) to a number average molecular weight (Mn) of 5 or less, and an acid value of from 6 mgKOH/g to 12 mgKOH/g, wherein the binder resin is a polyester resin, wherein the releasing agent is a monoester wax.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
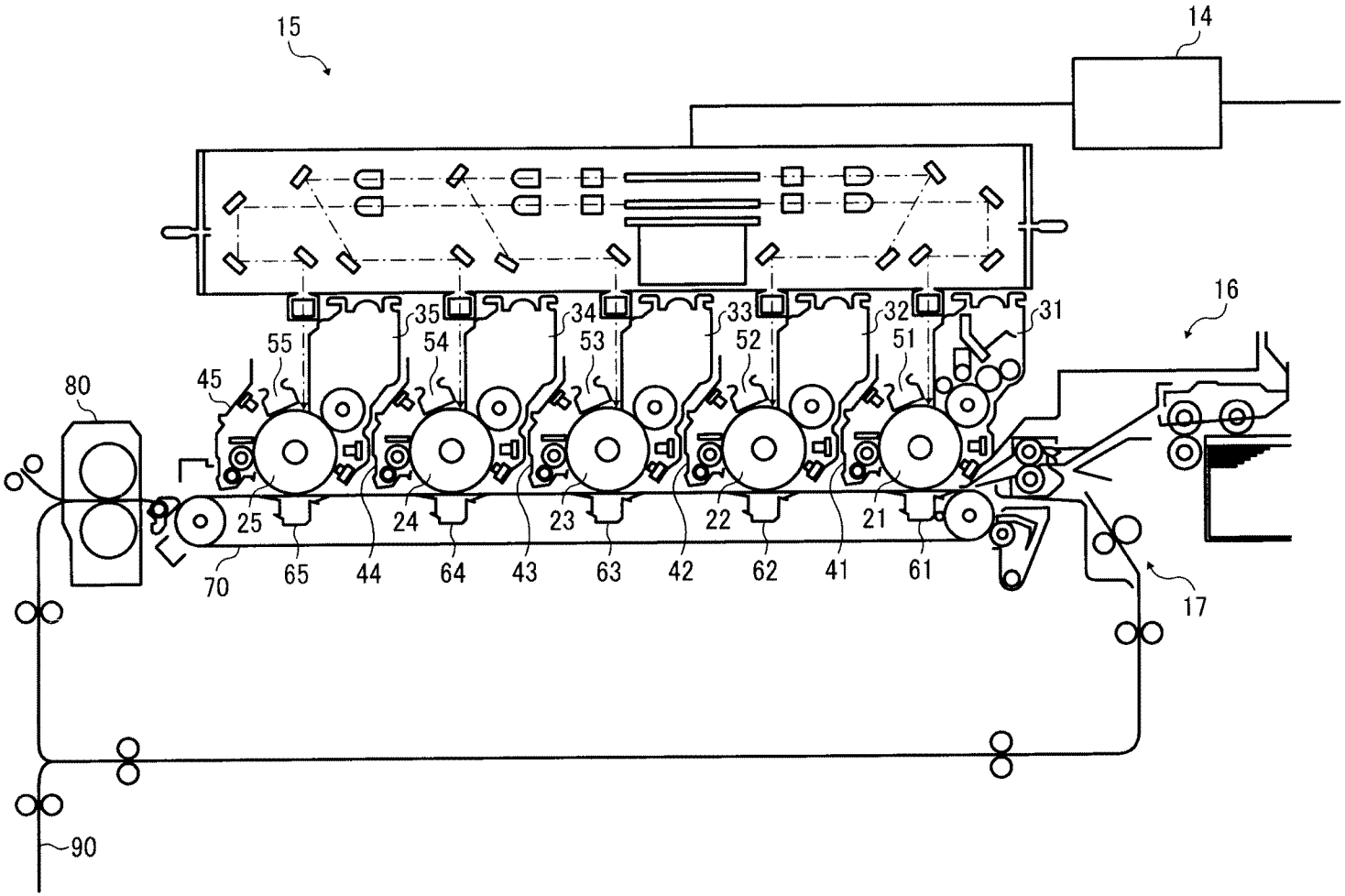
FIG. 1 is a front view illustrating an image forming apparatus A.

The present invention is to provide toner having excellent gloss close to photograph gloss over a wide fixing temperature range, extremely excellent low temperature fixability, excellent hot offset resistance, and good storage stability.

As a result of the investigation, the present inventors have found that toner having a polyester resin as binder resin; a monoester wax as releasing agent; and a tri- or higher metal salt, wherein the toner has a weight average molecular weight (Mw) of from 7,000 to 10,000, a ratio of the weight average molecular weight (Mw) to a number average molecular weight (Mn) of 5 or less, and an acid value of from 6 mgKOH/g to 12 mgKOH/g has excellent gloss close to photograph gloss over a wide fixing temperature range, extremely excellent low temperature fixability, excellent hot offset resistance, and good storage stability. Thus, the present invention was made.

In the present invention, toner is provided. Also, an image forming method and a process cartridge are also provided.

The present invention relates to the toner of the following 1 and also includes embodiments of 2 to 9.

1. Toner contains a binder resin and a releasing agent, wherein the toner has a weight average molecular weight (Mw) of from 7,000 to 10,000, a ratio of the weight average molecular weight (Mw) to a number average molecular weight (Mn) of 5 or less, and an acid value of from 6 mgKOH/g to 12 mgKOH/g, wherein the binder resin is a polyester resin, wherein the releasing agent is a monoester wax having a tri- or higher metal salt.

2. The toner of 1 mentioned above, further contains a wax dispersing agent, wherein the wax dispersing agent is a copolymer resin containing monomers of styrene, butyl acrylate, and acrylonitrile.

3. The toner of 1 or 2 mentioned above, wherein the toner is a transparent toner containing no colorant.

4. The toner of 1 or 2 mentioned above, further containing a colorant.

5. An image forming method including overlapping the toner of 3 mentioned above and a color and toner to form an image on a recording medium; and fixing the image on the rerecording medium.

6. An image forming method including regulating a transfer amount of a development agent containing the toner of any one of 1 to 4 mentioned above and carrier on a development agent bearing member by a regulating member; and developing an image formed on a photoreceptor with the toner of any one of 1 to 4 mentioned above, wherein the regulating member contains a magnetic plate and a non-magnetic plate, wherein the non-magnetic plate is arranged downstream of the regulating member in a transfer direction of the development agent, wherein the end surface of the magnetic plate protrudes closer toward a surface of the development agent bearing member than the end surface of the non-magnetic surface, wherein the downstream end in the transfer direction of the development agent on the end surface of the magnetic plate approaches closest to the surface of the development agent bearing member for development.

7. A process cartridge having an image bearing member to bear a latent electrostatic image thereon; and a development device to render the latent electrostatic image visible with a development agent containing the toner of any one of 1 to 4 mentioned above and carrier, wherein the process cartridge is detachably attachable to an image forming apparatus.

8. A printed matter having a recording medium and an image formed thereon by the image forming method of any one of 5 to 7 mentioned above.

The present invention is described in detail below.

The toner of the present disclosure is used for electrophotography, which contains at least a binder resin and a releasing agent with the following properties:

The toner has a weight average molecular weight (Mw) of from 7,000 to 10,000, a ratio of the weight average molecular weight (Mw) to the number average molecular weight (Mn) of 5 or less, and an acid value of from 6 mgKOH/g to 12 mgKOH/g.

The binder resin is a polyester resin

The releasing agent is a monoester wax.

The toner contains a tri- or more metal salt.

The toner of the present disclosure has a weight average molecular weight (Mw) of from 7,000 to 10,000, preferably from 7,500 to 9,500, and more preferably from 8,000 to 9,000. When the weight average molecular weight is less than 7,000, the glass transition temperature of the toner tends to be low, meaning that the storage stability of the toner deteriorates, resulting in agglomeration of toner in a storage environment. In addition, the viscoelasticity of the toner at high temperatures becomes excessively low, thereby impairing the hot offset resistance of the toner. When the weight average molecular weight is greater than 10,000, the viscoelasticity tends to become high, ductility becomes inferior, which has an adverse impact on low temperature fixability and gloss.

In addition, the ratio of the weight average molecular weight (Mw) to the number average molecular weight (Mn) is 5 or less and preferably 4 or less. When the ratio of the weight average molecular weight (Mw) to the number average molecular weight (Mn) surpasses 5, gloss tends to become inferior.

The number average molecular weight and the weight average molecular weight of the toner of the present disclosure can be obtained by measuring the molecular weight distribution of the dissolved portion of the toner in tetrahydrofuran (THF) by a gel permeation chromatography (GPC) measuring instrument (GPC-150C, manufactured by Waters Corporation).

The number average molecular weight and the weight average molecular weight of the toner of the present disclosure is measured by using a column (KF801 to 807, manufactured by SHOWA DENKO K.K) according to the following method:

The column is stabilized in a heat chamber at 40° C. and tetrahydrofuran is flown as solvent at 1 mL/min in the column at this temperature. Thereafter, 0.05 g of a sample is sufficiently dissolved in 5 g of THF followed by filtration by a filter for preprocessing (for example, Chromatodisc having hole diameter of 0.45 μm, manufactured by Kurabo Industries Ltd.). In the end, the filtrate is adjusted in such a manner that the sample concentration is from 0.05% by weight to 0.6% by weight and 50 μL to 200 μL of the THF sample solution is infused for measuring.

In the weight average molecular weight Mw and the number average molecular weight Mn of the THF solution portion of the sample, the molecular weight distribution of the sample is calculated by the relation between the logarithm values of the standard curves made from several kinds of the monodispersed polystyrene standard samples and the count values.

As the standard polystyrene sample for the standard curve, it is suitable to use at least about ten standard polystyrene samples among, for example, polystyrene samples having a molecular weight of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, or $4.48\times10^6$, manufactured by TOSOH CORPORATION or Pressure Chemical Co. A refractive index (RI) detector is used as the detector.

The toner of the present disclosure has an acid value of from 6 mgKOH/g to 12 mgKOH/g. At the time of fixing, the acid group in the polyester resin and the tri- or higher metal salt described later moderately form a cross-linked structure, thereby obtaining excellent hot offset resistance while maintaining good low temperature fixability. When the acid value surpasses 12 mgKOH/g, the cross-linking structure with the metal salt tends to increase, so that gloss becomes inferior while hot offset resistance ameliorates. When the acid value is lower than 6 mgKOH/g, the cross-linking structure with the metal salt tends to decrease, thereby degrading hot offset resistance.

Specifically, the acid value of the toner is determined in the following procedure:

Measuring device: automatic potentiometric titrator DL-53 Titrator, manufactured by Mettler Toledo International Inc.

Electrode: DG113-SC, manufactured by Mettler Toledo International Inc.

Analyzing software: LabX Light Version 1.00.000

Calibration of device: Using a liquid solvent of 120 ml of toluene and 30 ml of ethanol Measuring Temperature: 23° C.

The measuring conditions are as follows.

Stirring condition:
- Stirring speed (%): 25
- Stirring time (s): 15

Equilibrium titration condition:
- Volumetric solution: $CH_3ONa$
- Concentration (mol/L): 0.1
- Electrode: DG 115
- Measuring unit: mV
- Titration of volumetric solution prior to measuring
- Titer (mL): 1.0
- Waiting time (s): 0
- Titration mode of volumetric solution: Dynamic
- dE (set) [mV]: 8.0
- dV (min) [mL]: 0.03
- dV (max) [mL]: 0.5

Measuring mode: equilibrium titration
- dE [mV]: 0.5
- dt [s]: 1.0
- t (min) [s]: 2.0
- t (max) [s]: 20.0

Recognition condition
- Threshold: 100.0
- Only maximum change rate: No
- Range: No
- Frequency: None Measuring complete condition:
- Maximum titer (mL): 10.0
- Voltage: No
- Gradient: No
- After equivalent point: Yes
- n number: 1
- Combination of complete conditions: No Evaluation condition
- Procedure: Standard
- Voltage 1: No
- Voltage 2: No
- Stop for re-evaluation: No The acid value of toner is measured under the following condition according to the method described in JIS K0070-1992.

Sample preparation: 0.5 g of toner (0.3 g as portion soluble in ethyl acetate) is added to 120 ml of toluene and dissolved therein by stirring at room temperature (23° C.) for about 10 hours. 30 ml of ethanol is added thereto prepare a sample solution.

The acid value is measured and calculated by the measuring device specified above.

Specific calculation is as follows:

Titration is conducted using preliminarily set alcohol solution of 0.1 N potassium hydroxide and the acid value is obtained by the following relation based on the consumption amount of the alcohol solution of potassium:

Acid value: KOH (ml number)×N×56.1/sample mass (where N represents a factor of N/10 KOH)

The binder resin of the toner of the present disclosure is a polyester resin and the weight average molecular weight thereof is from 7,000 to 10,000, preferably from 7,500 to 9,500, and more preferably from 8,000 to 9,000. In addition, the ratio of the weight average molecular weight (Mw) to the number average molecular weight (Mn) is 5 or less and preferably 4 or less. In addition, the acid value is from 6 mgKOH/g to 12 mgKOH/g. Low temperature fixability and hot offset resistance are easily compatible by using a polyester resin.

Any polyester resin obtained by polycondensation reaction of known alcohol and acid is suitably used as the polyester resin in the present disclosure Specific examples of alcohols include, but are not limited to, diols such as polyethylene glycol, diethylene glycol, triethylene glycol, 1,2-propylene glycol, 1,3-propylene glycol, diols, 1,4-propylene glycol, neopentyl glycol, neopentyl glycol, and 1,4-butene diol; etherified bisphenols such as 1,4-bis(hydroroxymethyl)cyclohexane, bisphenol A, hydrogenated bisphenol A, polyoxyethyed bisphenol A, and polyoxypropylened bisphenol A; diol units in which these are substituted by saturated or unsaturated hydrocarbon groups having 3 to 22 carbon atoms; other diol units; tri- or higher alcohl monomers such as sorbitol, 1,2,3,6-hexanetetrol, 1,4-sorbitan, pentaerythritol, dipentaerythritol, tripentaerythritol, saccharose, 1,2,4-butane triol, 1,2,5-pentane triol, glycerol, 2-methylpropane triol, 2-methyl-1,2,4-butane triol, trimethylol ethane, trimethylol propane, 1,3,5-trihydroxy benzene.

Specific examples of carboxylic acids for use in preparation of polyester resins include, but are not limited to, monocarboxylic acids such as palmitic acid, stearic acid, and oleic acid; divalent organic acids such as maleic acid, fumaric acid, mesconic acid, citraconic acid, terephthalic acid, cyclohexane dicarboxylic acid, succinic acid, adipic acid, sebatic acid, and malonic acid, and divalent organic acid monomers in which these are substituted by saturated or unsaturated hydrocarbon groups having 3 to 22 carbon atoms; anhydrides of these acids; dimers of a lower alkyl ester and linoleic acid; 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, tetra (methylenecarboxyl)methane, 1,2,7,8-octane tetracarboxylic acid, Empol® trimer acid, and polyvalent carboxylic acid monomer of anhydrides of these aids.

The toner of the present disclosure contains a tri- or higher metal salt. By containing such a metal salt, the acid group of a binder resin and the metal salt conduct cross-linking reaction during fixing, thereby forming a weak three-dimensional network, so that good hot offers resistance is obtained while good low temperature fixability is maintained.

As the metal salt, for example, it is suitable to contain at least one kind of metal salts selected from salicylic acid derivatives and acetylacetonato metal salts. As the metal, any tri- or higher ion metal can be used. Specific examples thereof include, but are not limited to, iron, zirconium, aluminum, titanium, and nickel.

A specific example of the tri- or higher metal salts is a tri- or higher salicylic acid metal compound.

The content of the metal salt is preferably from 0.5 part by weight to 2 parts by weight and more preferably from 0.5 parts by weight to 1 part by weight to 100 parts by weight of toner. When the content is less than 0.5 part by weight, hot offset resistance tends to deteriorate. When the content is greater than 2 part by weight, hot offset resistance ameliorates but gloss may deteriorate.

The toner of the present disclosure contains a monoester wax as the releasing agent.

Since monoester waxes have low compatibility with a typical binder resin, they easily expose to the surface during fixing, thereby demonstrating good releasability to secure good gloss and excellent low temperature fixability.

In addition, the toner of the present disclosure preferably contains the monoester wax in an amount of from 4 parts by weight to 8 parts by weight and more preferably from 5 parts by weight to 7 parts by weight to 100 parts by weight of the toner. When the content of monoester wax is less than 4 parts by weight, oozing of the wax during fixing is insufficient, which leads to degradation of relesability, resulting in deterioration of gloss, low temperature fixability, and hot offset resistance When the content of monoester wax is greater than 8 parts by weight, the amount of releasing agents easily surfacing to the surface of toner increases, the storage property of toner easily deteriorates, and filming resistance to a photoreceptor is degraded.

It is preferable to use a synthesized wax as the monoester wax mentioned above. An example of such a synthesized wax is a monoester wax synthesized by a saturated linear long chain aliphatic acid and a saturated linear long chain alcohol. the saturated linear long chain aliphatic acid is represented by $C_nH_{2+1}COOH$. "n" is preferably from about 5 to about 28. The saturated linear long chain alcohol is represented by CnH2n+1OH. "n" is preferably from about 5 to about 28.

Specific examples of the saturated linear long chain aliphatic acids include, but are not limited to, capric acid, undecylic acid, lauric acid, tridecylic acid, myristic acid, pentadecylic acid, palmitic acid, hepta decanic acid, tetradecanic acid, stearic acid, nonadecanic acid, aramonic acid, behenic acid, lignoceric acid, cerotic acid, heptacosanoic acid, montanic acid, and melissic acid Specific examples of the saturated linear long chain alcohols include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol. These may have substituted groups such as lower alkyl groups, amino groups, halogen atoms, etc.

The toner of the present disclosure preferably contains a wax dispersant. As the wax dispersant, a copolymer composition containing at least styrene, butyl acrylate, and acrylonitrile as monomers or an adduct of such a copolymer composition with polyethylene is more preferable.

In comparison with polyester resins serving as the binder resin of the toner of the present disclosure, styrene resins are well compatible with typical wax so that the dispersion state of wax tends to be small. In addition, styrene resins have weak inside agglomeration force so that styrene resins have good pulverization property in comparison with polyester resins. Therefore, if the dispersion state of wax is significantly the same, the probability of the interface between the wax and styrene resin being a pulverized phase is low unlike the case of a polyester resin. The amount of wax present on the surface of toner particles can be subdued, thereby improving the storage property of toner.

Moreover, since a polyester resin serving as the binder resin of the present disclosure is incompatible with a styrene resin, gloss tends to be lowered. In the present disclosure, it is possible to prevent gloss from lowering even if such an incompatible resin is selected because butyl acrylate is selected as acrylic species, which has an SP value close to that of a polyester-based resin among conventional styrene resins. Moreover, a styrene resin having butyl acrylate as the acrylic species tends to have thermal properties close to those of a polyester resin, so that the low temperature fixability and inside agglomeration force of the polyester resin does not significantly change.

The ratio of the wax dispersant is preferably 7 parts by weight or less to 100 parts by weight of toner. Dispersion effect is obtained by containing a wax dispersant and the storage property of toner is stably improved irrespective of the manufacturing method thereof. In addition, due to the dispersion effect of the wax, the wax diameter decreases, thereby subduing filming phenomenon to a photoreceptor, etc. When the content is greater than 7 parts by weight, non-compatible components to polyester resins increases, thereby lowering gloss. In addition, the dispersion property of the wax is excessive, oozing of the wax to the surface of toner during fixing is worsened although filming resistance increases, so that low temperature fixability and hot offset resistance deteriorate.

Specific examples of the coloring agents include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures thereof. The content of a colorant is from 0.1 parts by weight to 80 parts by weight to 100 parts by weight of a binder resin in general.

Furthermore, transparent toner and colored toner optionally contain external additives.

Examples of such external additives are, for example, abrasives such as silica, Teflon® resin powder, polyvinylidene fluoride powder, cerium oxide powder, silicon carbide powder, and strontium titanate powder, fluidity improvers such as titanium oxide powder, and aluminum oxide powder, agglomeration inhibitors, resin powder, and conductivity imparting agents such as zinc oxide powder, antimony oxide powder, and tin oxide powder. In addition, white particulates and black particulates having reverse polarity can be used as development improvers. These can be used alone or in combination. These are added to be against development stress such as idling.

When employing two-component development system, spinel ferrites such as magnetite and gamma ferric oxide, spinel ferrites having one or two kinds of metals Mn, Ni, Zn, Mg, Cu, etc. other than iron, magnetoplumbite type ferrites such as barium ferrite, and iron or alloyed metal particles having an oxidized layer on the surface can be used as magnetic particulates for use in magnetic carriers. These particulates take spherical form, needle-like form, etc. In particular, it is preferable to use ferromagnetic particulates such as iron when strong magnetization is demanded. In addition, considering chemical stability, it is preferable to use spinel ferrites containing magnetite and gamma ferric oxide, etc. and magnetoplumbite type ferrites such as barium ferrite. It is possible to use resin carriers having a desired magnetiazation by selecting the kind and the content of ferromagnetic particulates. Such a carrier has a magnetization of from 30 emu/g to 150 emu/g in 1,000 oersted.

Such resin carriers are manufactured by spraying a melt-kneaded material of magnetized particulates and a binder resin having insulation property by a spray drier. Also, resin carriers can be manufactured in which magnetized particulates are dispersed in a condensed type binder formed by reacting and curing monomers or prepolymers in an aqueous medium under the presence of magnetized particulates.

It is possible to control the chargeability of a magnetized carrier by fixating positively or negatively charged particulates or electrocondictuve particulates on the surface of the magnetized carrier or coating the magnetized carrier with a resin.

As the coating material for the surface of a magnetized carrier, silicone resins, acrylic resins, epoxy resins, fluorine-containing resins, etc. are be used, Furthermore, the surface thereof can be coated with a material containing positively or negatively charged particulates or electroconductive particulates. Of these, silicone resins and acrylic resins are preferable.

The mixing ratio of the toner of the present disclosure and magnetized carriers is preferably from 2% by weight to 10% by weight as toner concentration.

The weight average molecular weight of toner is preferably from 2 μm to 25 μm.

The particle size of toner is measured by various methods. For example, 50,000 particles obtained by dispersing toner added to an electrolyte containing a surfactant by an ultrasonic dispersing device for one minute are measured by using Coulter Multisizer III.

To manufacture the transparent toner and colored toner of the present disclosure, a resin for binding, a releasing agent, optional materials such as a colorant, and a further optional resin for binding in which a charge control agent, a releasing agent, and an additive are uniformly dispersed are mixed by a mixer such as HENSCHEL MIXER or SUPER MIXER. Thereafter, heat-melting mixing kneader such a heating roller, kneader, and extruder are used to mix the raw materials sufficiently. Subsequent to cooling and solidification, the mixture is finely-pulverized and classified to obtain toner.

As the pulverization method, it is possible to employ a jet mill method of adding toner to a jet air followed by collision with a collision board to pulverize the toner using its collision energy, an interparticle collision method of colliding toner particles in an air stream, or a mechanical pulverization method of supplying toner into a narrow gap with a rotor rotating at high speed.

In addition, a dissolution suspension method can be employed in which mother toner particles are manufactured by dispersing in an aqueous medium phase an oil phase in which toner materials are dissolved or dispersed in an organic solvent phase to conduct resin reaction followed by removal of the solvent, filtration and washing, and drying.

An image forming apparatus A is described which is used for the transparent toner, colored toner and the transparent toner, and a two component development agent formed of a colored toner and carrier.

Image Forming Method 1

FIG. 1 is a diagram illustrating the entire of the image forming apparatus A. An image forming method 1 is described first.

An image processing unit (IPU) 14 forms image signals for each of five colors of yellow (Y), magenta (M), cyan (C), black (Bk), and transparent from image data sent to the IPU 14.

Thereafter, the IPU 14 transmits each image signal of Y, M, C, Bk, and transparent to a writing unit 15. After charging units 51, 52, 53, 54, and 55 charge drum photoreceptors 21, 22, 23, 24, and 25, the writing unit 15 sequentially scans the drum photoreceptors 21, 22, 23, 24, and 25 with modulated five laser beams of Bk, Y, M, C, and transparent, to form latent electrostatic images thereon. In FIG. 1, the first drum photoreceptor 21, the second drum photoreceptor 22, the third drum photoreceptor 23, the fourth drum photoreceptor 21, and the fifth drum photoreceptor 25 correspond to Bk, Y, M, C, and transparent, respectively.

Next, development units 31, 32, 33, 34, and 35 serving as development agent attachment devices form each color toner image on the drum photoreceptors 21, 22, 23, 24, and 25, respectively. In addition, a transfer sheet is fed from a sheet feeder 16 and conveyed on a transfer belt 70. The toner images on the drum photoreceptors 21, 22, 23, 24, and 25 are sequentially transferred to the transfer sheet by transfer chargers 61, 62, 63, 64, and 65, respectively.

After this transfer process, the transfer sheet is conveyed to a fixing unit 80, where the transferred toner image is fixed on the transfer sheet.

After the transfer process, toner remaining on the drum photoreceptors 21, 22, 23, 24, and 25 are removed by cleaning units 41, 42, 43, 44, and 45, respectively.

Image Formation Method 2

Next, an image forming method 2 of locally imparting high gloss is described with reference to FIG. 2.

The image processing unit (IPU) 14 forms image signals for each of five colors of yellow (Y), magenta (M), cyan (C), black (Bk), and transparent from image data sent to the IPU 14 in the same manner as in the image forming method 1.

Next, the IPU 14 locally forms first images having high gloss. The IPU 14 transmits each image signal of Y, M, C, Bk, and transparent of the portion with high gloss to the writing unit 15. After charging units 51, 52, 53, 54, and 55 charge drum photoreceptors 21, 22, 23, 24, and 25, the writing unit 15 sequentially scans the drum photoreceptors 21, 22, 23, 24, and 25 with modulated five laser beams of Bk, Y, M, C, and transparent, to form latent electrostatic images thereon. In FIG. 1, the first drum photoreceptor 21, the second drum photoreceptor 22, the third drum photoreceptor 23, the fourth drum photoreceptor 21, and the fifth drum photoreceptor 25 correspond to Bk, Y, M, C, and transparent, respectively.

Next, the development units 31, 32, 33, 34, and 35 serving as development agent attachment devices form each color toner image on the drum photoreceptors 21, 22, 23, 24, and 25, respectively. In addition, a transfer sheet is fed from the sheet feeder 16 and conveyed on the transfer belt 70. The toner images on the drum photoreceptors 21, 22, 23, 24, and 25 are sequentially transferred to the transfer sheet by the transfer chargers 61, 62, 63, 64, and 65, respectively.

After this transfer process, the transfer sheet is conveyed to the fixing unit 80, where the transferred toner image is fixed on the transfer sheet.

After the transfer process, toner remaining on the drum photoreceptors 21, 22, 23, 24, and 25 are removed by cleaning units 41, 42, 43, 44, and 45, respectively.

The fixed transfer sheet is conveyed to a fixed transfer sheet conveyor 17 to conduct second image forming.

In the second image forming, each image signal for the portions with normal gloss where no first image forming has not been conducted by image processing is transmitted to the writing unit 15. The images of Y, M, C, and Bk other than transparent are written on the drum photoreceptors 21, 22, 23, and 24, respectively, followed by the steps of development, transfer, and fixing in the same manner as in the first image forming.

With regard to the image forming for transparent, the transparent toner can be attached to a portion of the sheet having a thin density depending on the image processing or the entire portion or just a portion determined as image portion by designating areas.

Figure 2:
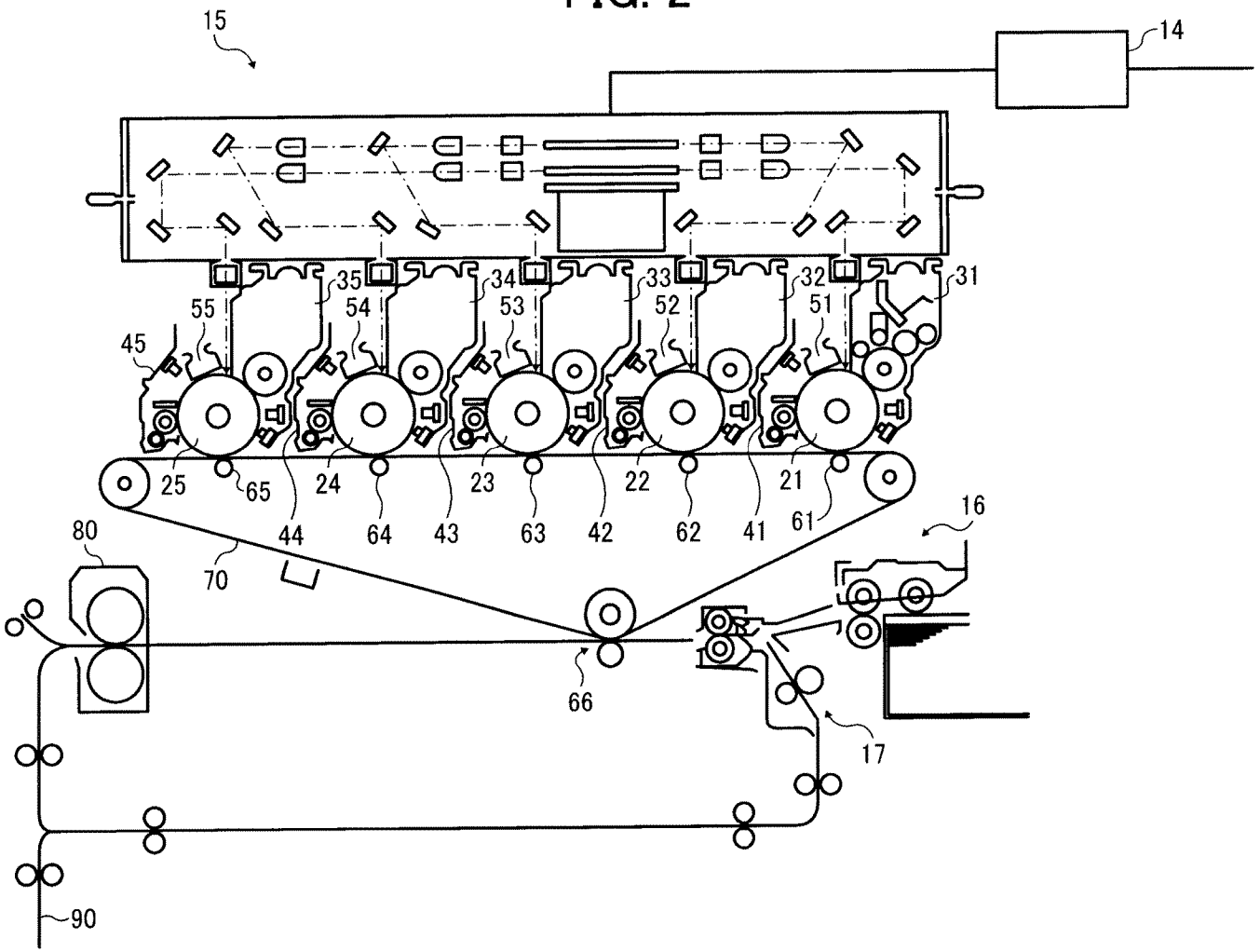
FIG. 2 is a front view illustrating an image forming apparatus B.
Figure 3:
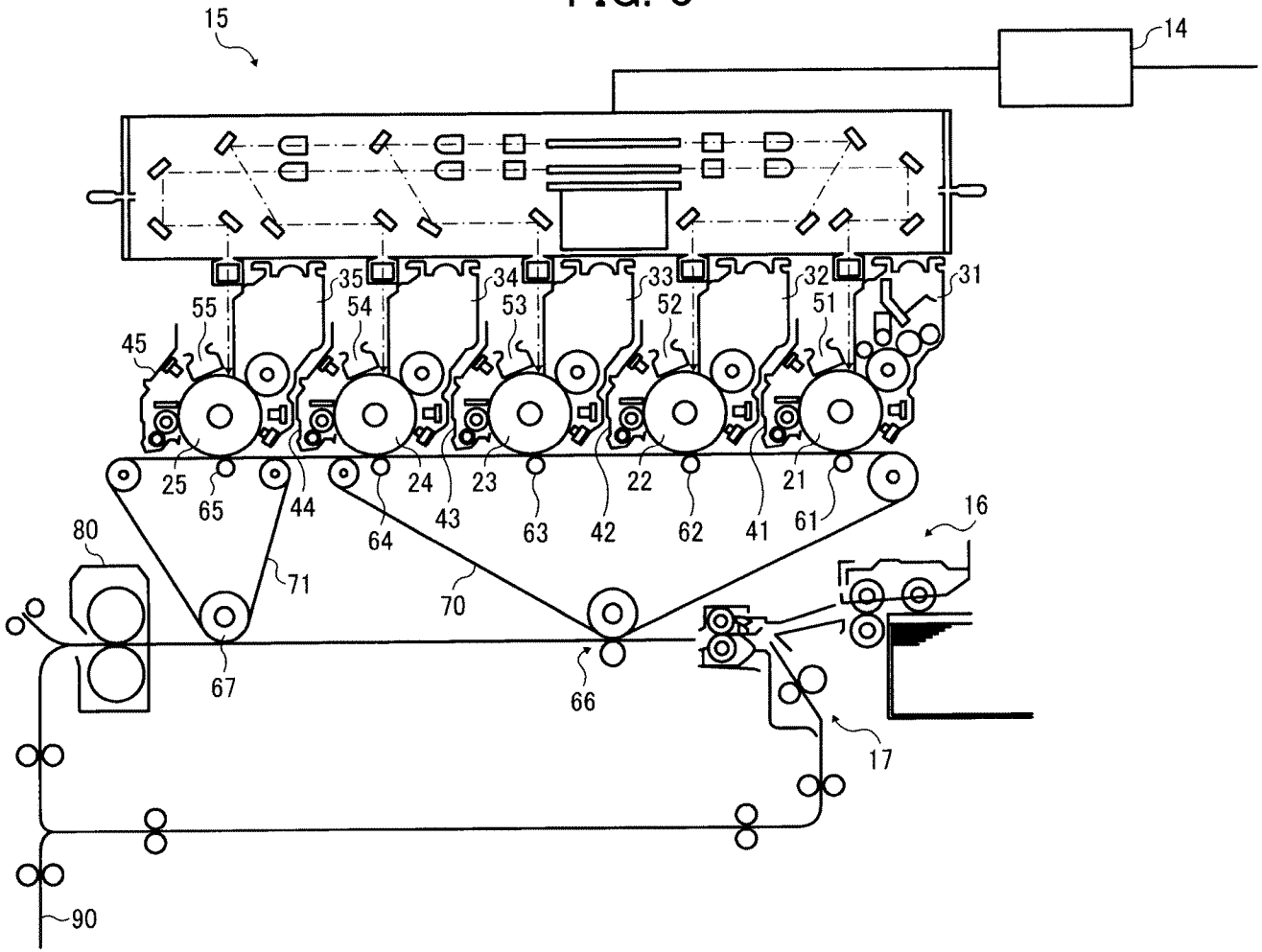
FIG. 3 is a front view illustrating an image forming apparatus C.

In the image forming method using the apparatus illustrated in FIG. 2, the toner images formed on the drum photoreceptors 21, 22, 23, 24, and 25 as in FIG. 1 are transferred to the transfer drum temporarily and thereafter transferred to the transfer sheet by a secondary transfer device 66 followed by fixing by the fixing device 80. Both image forming method 1 and image forming method 2 can be used. In a case in which the transparent toner is thickly applied, the transparent toner layer on the transfer drum becomes thick, which makes it difficult to conduct secondary transfer. Therefore, it is possible to provide a separate transfer drum 67 as illustrated in FIG. 3.

Next, the structure around the development unit is described.

Figure 5:
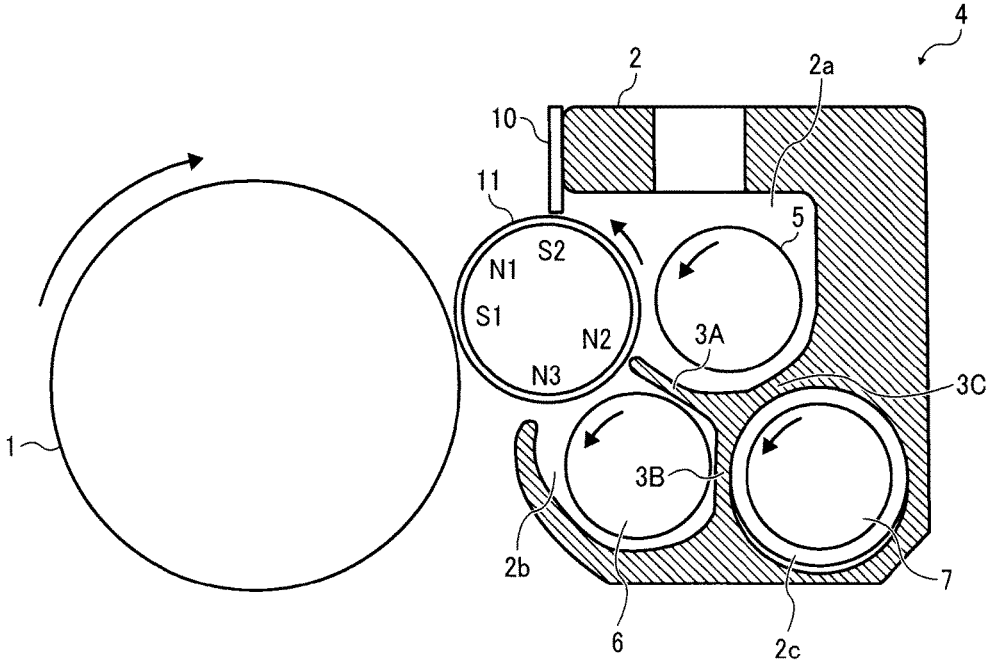
FIG. 5 is a cross section illustrating a schematic structure of a development device in an image forming apparatus.

FIG. 5 is an enlarged diagram illustrating one of the development units 31, 32, 33, 34, and 35 and one of the drum photoreceptors 21, 22, 23, 24, and 25. Each of the development units and each of the drum photoreceptors are the same except for the color of the toner, so that the development unit is represented as a development unit 4 and the drum photoreceptor is represented as a drum photoreceptor 1 in FIG. 5.

The development unit 4 of this embodiment includes a development agent container 2 accommodating a two-component development agent and a development sleeve 11 serving as development agent bearing member. The development sleeve 11 is rotatably arranged at the opening portion of the development agent container 2, facing the drum photoreceptor 1 with a predetermined gap therebetween. The development sleeve 11 employs a cylinder-like form made of a non-magnetic material. The portion facing the drum photoreceptor 1 rotates in the same direction as the drum photoreceptor 1 that rotates in the direction indicated by the arrow. Inside the development sleeve 11, a magnet roller serving as a magnetic field generating device is provided in a fixed manner. The magnet roller has five magnetic poles N1, S1, $N_2$, N3, and S2. A regulating member (blade) 10 serving as development agent regulating member is provided to the portion of the development agent container 2 located above the development sleeve 11. This regulating blade 10 is arranged in a non-contact manner with the development sleeve 11, close to the magnetic pole S2, which is substantially situated at the top of the magnet roller about the vertical direction.

Inside the development agent container 2, there are provided three development agent conveying paths of a supplying path 2*a*, a collection path 2*b*, and a stirring path 2*c*, which have a supplying screw 5 serving as first development agent stirring and conveying device, a collection screw 6 serving as second development agent stirring and conveying device, a stirring screw 7 serving as third development agent stirring and conveying device, respectively. The supplying path 2*a* and the stirring path 2*c* are arranged in a diagonal way. In addition, the collection path 2*b* is arranged downstream of the development area of the development sleeve 11, substantially horizontally with the stirring path 2*c*.

The two component agent accommodated in the development agent container 2 is supplied to the development sleeve 11 from the supplying path 2*a* while conveyed in the supplying path 2*a*, the collection path 2*b*, and the stirring path 2*c* in a circulation manner by stirring and conveying by the supplying screw 5, the collection screw 6, and the stirring screw 7. The development agent is lift onto the development sleeve 11 by the magnetic pole N2 of the magnet roller. As the development sleeve 11 rotates, the development agent is conveyed on the development sleeve 11 from the magnetic pole S2 to the magnetic pole N1 to the magnetic pole S1 and reaches the development agent where the development sleeve 11 and the drum photoreceptor 1 face each other. In the middle of the conveyance of the development agent, the thickness thereof is magnetically regulated by a combination of the development sleeve 11 and the magnetic pole S2, so that a thin layer of the development agent is formed on the development sleeve 11.

The magnetic pole S1 situated in the development area in the development sleeve 11 is a main development magnetic pole. The development agent conveyed to the development area forms filament on the development sleeve 11 and contacts the surface of the drum photoreceptor 1 to develop a latent electrostatic image formed thereon. The development agent that has developed the latent electrostatic image passes through the development area as the development sleeve 11 rotates, is returned to the development agent container 2 via the transfer pole N3, is detached from the development sleeve 11 by the repulsion magnetic field formed by the magnetic poles N2 and N3, and is thereafter retrieved to the collection path 2*b* by the collection screw 6.

The supplying path 2*a* and the collection path 2*b* situated obliquely below the supplying path 2*a* are separated by a first partition 3A.

Figure 6:
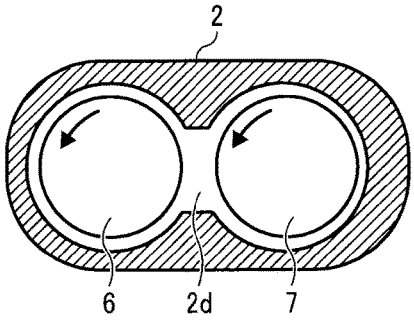
FIG. 6 is a cross section illustrating a collection transfer path and a stirring transfer path at the downstream portion of the collection transfer path in the transfer direction.

The collection path 2*b* and the stirring path 2*c* provided on the lateral side thereof are separated by a second partition 3B. On the downstream of the collection path 2*b* from the transfer direction by the collection screw 6 is provided an opening for development agent supply to supply the collected development agent to the stirring path 2*c*. FIG. 6 is a cross section illustrating the collection path 2*b* and the stirring path 2*c* on the downstream portion from the transfer direction by the collection screw 6. An opening portion 2*d* is provided to communicate the collection path 2*b* and the stirring path 2*c*.

Figure 7:
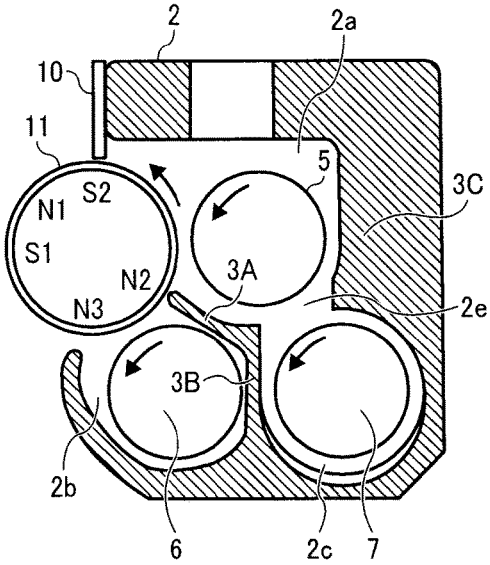
FIG. 7 is a cross section illustrating a supply transfer path of the upstream portion in the transfer direction in a development device of an image forming apparatus.
Figure 8:
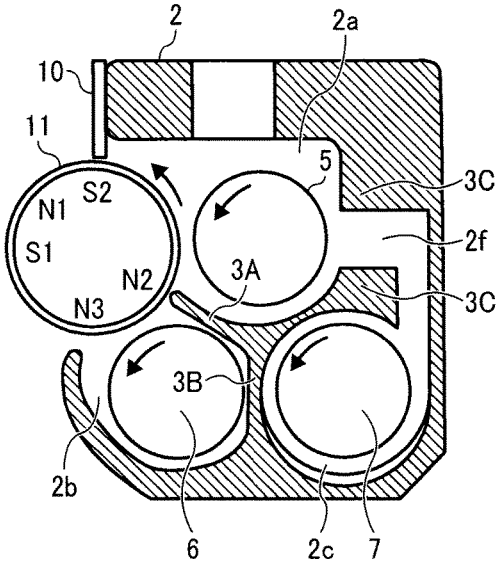
FIG. 8 is a cross section illustrating a supply transfer path of the downstream portion in the transfer direction in the development device of FIG. 7.

In addition, the supplying path 2*a* and the stirring path 2*c* provided obliquely below the supplying path 2*a* are separated by a third partition 3C. On the downstream and the upstream portions of the supplying path 2*a* from the transfer direction by the supplying screw 5 is provided an opening for development agent supply to supply the development agent. FIG. 7 is a cross section illustrating the development unit 4 on the upstream portion from the transfer direction by the supplying screw 5. An opening portion 2*e* is provided to the third partition 3C to communicate the stirring path 2*c* and the supplying path 2*a*. FIG. 8 is a cross section illustrating the development unit 4 on the downstream portion from the transfer direction by the supplying screw 5. An opening portion 2*f* is provided to the third partition 3C to communicate the stirring path 2*c* and the supplying path 2*a*.

Next, the circulation of the development agent in the three paths of the development age t is described.

Figure 9:
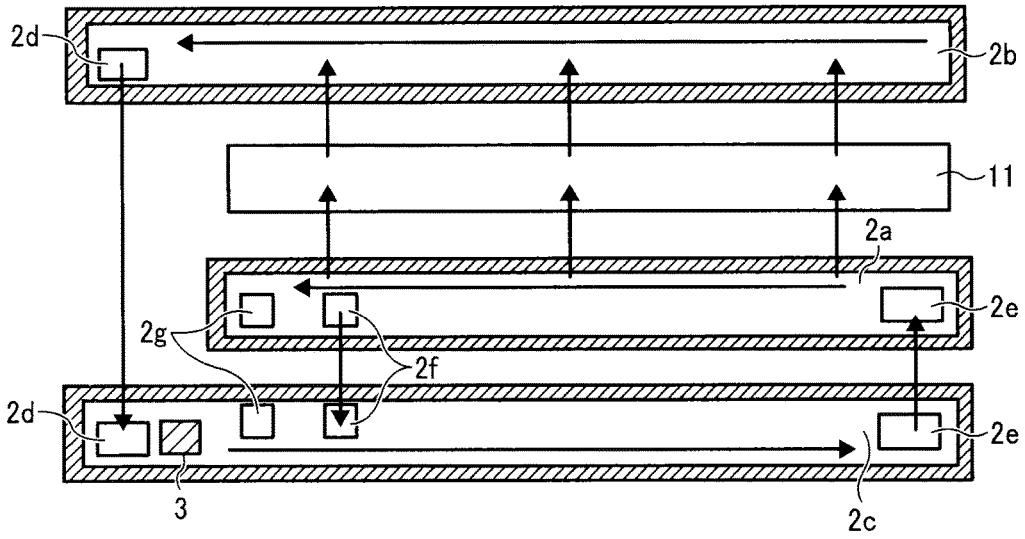
FIG. 9 is a schematic diagram illustrating a flow of a development agent in the development device of FIG. 7.

FIG. 9 is a schematic diagram illustrating the flow of the development agent in the development unit 4. Each arrow in FIG. 9 indicates the moving direction of the development agent. At the supplying path 2*a* where the development agent is supplied from the stirring path 2*c*, the development agent is conveyed downstream in the transfer direction of the supplying screw 5 while the development agent is supplied to the development sleeve 11. Redundant development agent, which is not supplied to the development sleeve 11, is transferred to the downstream portion in the transfer direction of the supplying path 2*a* and supplied to the stirring path 2*c* from the opening portion 2*f* provided to the third partition 3C as the opening portion for the first development agent supply.

In addition, the collected development agent, which is collected from the development sleeve 11 to the collection path 2*b* by the collection screw 6 and transferred to the downstream portion in the same direction of the development agent in the supplying path 2*a*, is supplied to the stirring path 2*c* from the opening portion 2*d* provided to the second partition 3B as the opening portion for the second development agent supply.

In the stirring path 2*c*, the redundant development agent and the collected development agent are stirred by the stirring screw 7 and transferred in the direction opposing the transfer direction of the development agent in the collection path 2*b* and the supplying path 2*a*. Thereafter, the development agent transferred to the downstream side in the transfer direction of the stirring path 2*c* is supplied to the upstream portion in the transfer direction of the supplying path 2*a* from the opening portion 2*e* provided to the third partition 3C as the opening portion for the third development agent supply.

In addition, below the stirring path 2*c* is provided a toner concentration detector. Due to the output from the detector, a toner supplying control device is operated to supply toner from the toner container. In the stirring path 2*c*, the toner supplied from a toner supplying mouth 3 is transferred to the downstream in the transfer direction while being stirred together with the collected development agent and the redundant development agent. It is preferable to supply toner upstream of the stirring screw 7 to take a longer time for stirring between supply and development.

As described above, the development unit 4 includes the supplying path 2*a* and the collection path 2*b*, meaning that the development agent is collected and supplied in the different paths, the development agent already used for development is not mingled in the supplying path 2*a*.

Therefore, it is possible to prevent the concentration of toner supplied to the development sleeve 11 from decreasing as the development agent moves further downstream in the transfer direction of the supplying path 2*a*. Additionally, since the development unit 4 has the supplying path 2*a* and the collection path 2*b* and the development agent is collected and stirred in separate paths, the development agent already used for development does not drop into the middle of stirring. Accordingly, the development agent already sufficiently stirred is supplied to the supplying path 2*a*, so that the development agent supplied to the supplying path 2*a* is sufficiently stirred. As described above, the toner concentration of the development agent in the supplying path 2*a* is prevented from decreasing and the development agent in the supplying path 2*a* is sufficiently stirred, so that the image density at the time of development is kept constant.

In addition, in the upstream portion in the transfer direction of the supplying path 2*a* illustrated in FIG. 7, the development agent is supplied from the stirring path 2*c* to the supplying path 2*a* situated obliquely above the stirring path 2*c*. In this delivery (supply) of the development agent, the development agent is pressed in by the rotation of the stirring screw 7 to swell and overflow the development agent from the opening portion 2*e*. The way of such delivery is stress to the development agent, which leads to shortening of the working life of the development agent. In the development unit 4, since the supplying path 2*a* is arranged obliquely above the stirring path 2*c*, the stress the development agent receives in the transfer upward is subdued in comparison with the arrangement in which the supplying path 2*a* is provided vertically above the stirring path 2*c*.

Figure 10:
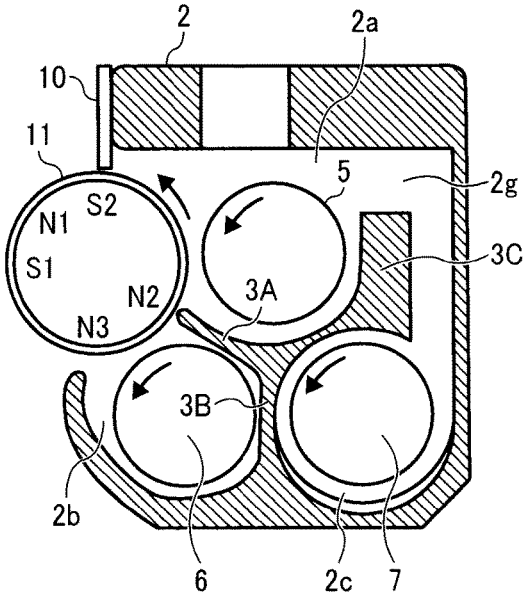
FIG. 10 is a cross section illustrating a supply transfer path of the furthermost downstream portion in the transfer direction in the image forming apparatus of FIG. 7.

Moreover, at the downstream portion in the transfer direction of the supplying screw 5 illustrated in FIG. 8, the development agent is supplied from the supplying path 2*a* to the stirring path 2*c* arranged obliquely below the supplying path 2*a* through the opening portion 2*f* provided to communicate the supplying path 2*a* with the stirring path 2*c*. The third partition member 3*c* that separates the stirring path 2*c* from the supplying path 2*a* extends from the bottom of the supplying path 2*a* upward and the opening portion 2*f* is provided above the bottom. FIG. 10 is a cross section illustrating the development unit 4 at the furthermost downstream portion in the transfer direction by the supplying screw 5. As illustrated in FIG. 10, at the downstream portion of the opening portion 2*f* in the transfer direction by the supplying screw 5, an opening portion 2*g* is provided to the third partition 3C to communicate the stirring path 2*c* and the supplying path 2*a*. In addition, the opening portion 2*g* is located above the top of the opening portion 2*f*.

At the supplying path 2*a* having the opening portions 2*f* and 2*g*, if the development agent transferred in the supplying path 2*a* to the opening portion 2*f* along the axis direction by the supplying screw 5 reaches the height of the height of the bottom of the opening portion 2*f*, the development agent spills down to the stirring path 2*c* situated below via the opening portion 2*f*. To the contrary, the development agent which does not reach the height of the bottom of the opening portion 2*f* is transferred further downstream by the supplying screw 5 and supplied to the development sleeve 11. At the portion downstream of the opening portion 2*f* inside the supplying path 2*a*, the height of the development agent becomes gradually lower than the bottom of the opening portion 2*f*.

Since the furthermost downstream of the supplying path 2*a* is a dead end, the height of the development agent may be higher there. However, if the height reaches a certain point, the development agent is pushed back to the opening portion 2*f* against the supplying screw 5. The development agent that has reached the height of the bottom of the opening portion 2*f* spills down to the stirring path 2*c* situated below via the opening portion 2*f*. Due to this, at the portion downstream of the opening portion 2*f* of the supplying path 2*a*, the height of the development agent does not continue increasing but reaches an equilibrium state having a certain gradient around the bottom of the opening portion 2*f*. By providing the opening portion 2*g* above the top of the opening portion 2*f*, that is, higher than this equilibrium state, the chance that aeration is insufficient because of clogging of the opening portion 2*f* by the development agent is slim. Therefore, sufficient aeration is secured at the stirring path 2*c* and the supplying path 2*a*.

That is, the opening portion 2*g* does not serve as an opening mouth for development agent supply between the supplying path 2*a* and the stirring path 2*c* but as an opening portion for aeration to secure sufficient aeration between the supplying path 2*a* and the stirring path 2*c*. By providing the opening portion 2*g* for aeration, if the inner pressure in the stirring path 2*c* provided below the opening portion 2*g* and the collection path 2*b* that communicates therewith increases, aeration is sufficiently secured with the supplying path 2*a* having a filter to pass air, thereby subduing an increase of the inner pressure in the entire development unit 4.

Next, the regulating blade 10 is described.

Figure 11:
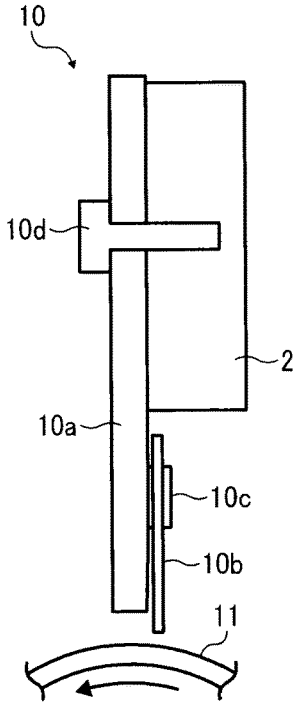
FIG. 11 is a diagram illustrating a schematic structure of a regulating blade of the development device of FIG. 7, shown as a cross section viewed from a direction perpendicular to the rotation axis of a development sleeve.

FIG. 11 is a schematic diagram illustrating the regulating blade 10 of this embodiment, shown as a cross section viewed from a direction perpendicular to the rotation axis of the development sleeve 11.

The regulating blade 10 of the embodiment has a non-magnetic plate 10*a* serving as blade and a magnetic plate 10*b* arranged upstream in the surface moving direction of the development sleeve 11, facing the non-magnetic plate 10*a*. In the regulating blade 10, one end surface (lower surface in FIG. 11) of the magnetic plate 10*b* and one end surface (lower surface in FIG. 11) of the non-magnetic plate 10*a* form a regulating surface.

The non-magnetic plate 10*a* is formed of, for example, a plate-like material made of SUS304 having a thickness of about 2 mm. The magnetic plate 10*b* is formed of, for example, a plate-like material made of SUS430 having a thickness of about 0.3 mm. The magnetic plate 10*b* is bound to the non-magnetic plate 10*a* by swaging a swage portion 10*c* having a half-blanking form made to the non-magnetic plate 10*a*. The non-magnetic plate 10*a* is attached to the development agent container 2 by a screw 10*d*.

The non-magnetic plate 10*a* can be formed by blanking by press working. In this working, a surface incurring burr (hereinafter referred to as burred surface) and a surface incurring droop (hereinafter referred to as drooped surface) are formed. In this embodiment, the magnetic plate 10*b* is fixed on the drooped surface of the non-magnetic plate 10*a*. In this case, even after polishing, grooves ascribable to droop of the non-magnetic plate 10*a* exist on the regulating surface of the regulating blade 10. The toner of a development agent or other foreign objects accumulate in the grooves, which grows in some cases. However, such accumulated and grown sedimentation has little impact in this embodiment since the end of the magnetic plate 10*b* is made to protrude from the end of the non-magnetic plate 10*a*. Alternatively, the magnetic plate 10*b* can be fixed on the burred surface of the non-magnetic plate 10*a*.

The magnetic plate 10*b* can be formed by blanking by press working like the non-magnetic plate 10*a*. In this case, a downstream end B in the surface moving direction of the development sleeve of the end of the magnetic plate can be either of the burred surface end or the drooped surface end.

In this embodiment, the end of the magnetic plate 10*b* of the regulating blade 10 protrudes more toward the surface of the development sleeve 11 than the end of the non-magnetic plate 10*a*. The amount of the protrusion is preferably, for example, from 0.2 mm to 0.5 mm. When this protrusion amount is greater than 0.5 mm, fluttering of a magnet brush is not sufficiently subdued by the non-magnetic plate 10*a* arranged downstream in the surface moving direction of the development sleeve, which easily results in toner scattering. In contrast, when this protrusion amount is less than 0.2 mm, the gap between the non-magnetic plate 10*a* and the development sleeve 11 tends to have an impact on the amount of the development agent regulated by the regulating blade 10. Therefore, the gap between the non-magnetic plate 10*a* and the development sleeve 11 has to be controlled with high accuracy.

The development agent which is borne on the surface of the development sleeve 11 and transferred according as the surface of the development sleeve 11 moves forms a magnet brush of filaments around the facing area of the magnet plate 10*b* and the development sleeve 11 by the magnetic field generated by the magnet roller. For example, if the amount of a development agent is regulated around 0.35 mg/cm$^2$ by the regulating blade 10, the gap between the magnetic plate 10 and the development sleeve 11 is set to be significantly the same as a typical regulating blade formed or a magnetic material.

Figure 12:
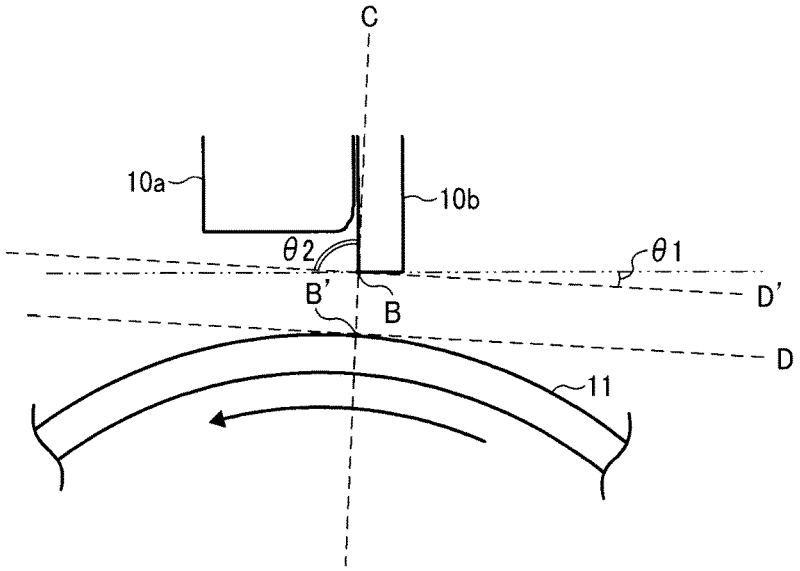
FIG. 12 is an enlarged view illustrating a facing area of the regulating blade and the development sleeve.

FIG. 12 is an enlarged view illustrating the facing area of the regulating blade 10 and the development sleeve 11 of this embodiment.

In this embodiment, in the end surface (lower surface) of the magnetic plate 10*b*, the downstream end in the surface transfer direction of the development sleeve is the most approaching point B, which is closest to the surface of the development sleeve 11. Therefore, regulating the amount of the development agent by the regulating blade 10 in this embodiment is complete when the development agent passes through the downstream end B in the surface moving direction of the development sleeve of the end surface of the magnetic plate.

In FIG. 12, if a normal line C is drawn about the surface of the development sleeve 11 to pass through the most approaching point B, the point on the surface of the development sleeve 11 on which this normal line C passes is defined as a point B'. About this point B', the tangent about the surface of the development sleeve 11 is represented by a symbol "D". When a virtual line D' that is parallel to the tangent D and passes through the most approaching point B is drawn, an angle θ1 formed by the virtual line D' and the magnetic plate end surface of the magnetic plate 10*b* is greater than 0° (angles counterclockwise relative to the virtual line D' in FIG. 12 are defined as plus). In this embodiment, the angle is close to 0°.

As the angle θ1 approaches to 0°, the change of the magnetic force becomes moderate in the magnetic plate end surface of the magnetic plate 10*b* from the upstream in the surface moving direction of the development sleeve toward the downstream end of the most approaching point B. Therefore, when the development agent moves from the upstream in the surface moving direction of the development sleeve toward downstream, the magnet brush is suitably maintained, which leads to stable regulation of the amount of the development agent.

In addition, in this embodiment, an angle θ2 formed by the virtual line D' and the plate surface of the magnetic plate 10*b* on the downstream side in the surface moving direction of the development sleeve, which is the plate surface facing the non-magnetic plate 10*a*, is preferably as large as possible, specifically, around 90°. As this angle θ2 increases, the magnetic field is drastically decreased on the downstream side in the surface moving direction of the development sleeve of the most approaching point B. For this reason, the top end of the magnet brush attached to the end surface of the magnetic plate until the most approaching point B is stably detached from the top end of the magnet brush at the most approaching point B.

In this embodiment, when the development agent passes through the magnetic plate end surface (lower surface in FIG. 12) of the magnetic plate 10*b*, the top end of the magnet brush formed of filaments of the development agent by the magnetic field of the magnet roller is transferred to the most approaching point B, which is the downstream end in the surface moving direction of the development sleeve, without being detached from the magnetic plate end surface. When the top end of the magnet brush reaches the most approaching point B, the top end of the magnet brush completes regulating the amount of the development agent at the same time when the top end of the magnet brush is detached from the magnetic plate end surface.

As a result of this phenomenon continuing without intermission, the amount of the development agent transferred to the development area is significantly uniform per unit of area on the surface of the development sleeve. In addition, this phenomenon is maintained even if magnetic carrier is easily magnetized excessively as the magnetic carrier in a development agent deteriorates. That is, let alone the initial stage in which magnetic carrier is free from deterioration, the amount of the development agent transferred to the development area is maintained significantly uniform per unit of area on the surface of the development sleeve over time during which deterioration of the magnetic carrier is in progress.

The development agent containing carrier and toner of the present disclosure can be applied to a process cartridge which has a photoreceptor integrally supported with at least one of a charger, a development device, and a cleaner and is detachably attachable to an image forming apparatus.

Figure 4:
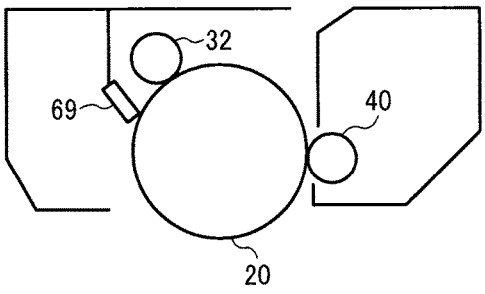
FIG. 4 is a schematic diagram illustrating an example of the process cartridge for use in the present disclosure.

FIG. 4 is a schematic diagram illustrating a process cartridge for an image forming apparatus, which accommodates a development agent containing the toner of the present disclosure.

The process cartridge illustrated in FIG. 4 has an image bearing member (photoreceptor) 20, a charger 32, a development device 40, and a cleaner 69.

In the present disclosure, the process cartridge is formed of the image bearing member 20 described above and at least one optional element of the charging device (charger) 32, the development device 40, and the cleaning device (cleaner) 69, and installed on an image forming apparatus such as a photocopier and a printer in a detachably attachable manner.

The operation of the image forming apparatus including a process cartridge accommodating the development agent of the present disclosure is as follows:

First, the image bearing member is rotationally driven at a predetermined circumference speed. The image bearing member is uniformly charged negatively or positively to a predetermined voltage at its surface by the charging device while in the rotation process. Then, the image bearing member is irradiated with slit irradiation or a laser beam scanning irradiation by an irradiation device according to obtained image information.

Thus, a latent electrostatic image is formed on the surface of the image bearing member and developed with toner by the development device. The developed toner image is transferred to a transfer medium which is fed from a paper feeder to the portion between the image bearing member and the transfer device in synchronization with the rotation of the image bearing member. The transfer medium having the toner image thereon is separated from the surface of the image bearing member, introduced into the fixing device where the toner image is fixed on the transfer medium and then discharged outside as an output (a photocopy or a print). The surface of the image bearing member after the image transfer is cleared of residual toner remaining thereon by the cleaning device, discharged and then ready for the next image forming cycle.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

It is to be noted that it will be apparent to one of ordinary skill in the art that many suitable changes and modifications can be made to the embodiments of the present invention described above to make other embodiments, these changes and modifications are within the scope of the present invention, and the following descriptions are merely examples in preferable embodiments of the present invention and are not limiting.

Measuring of Molecular Weight of Toner

The number average molecular weight and the weight average molecular weight of the toner manufactured as described below was obtained by measuring the molecular weight distribution of the dissolved portion of the toner in tetrahydrofuran (THF) by a gel permeation chromatography (GPC) measuring instrument (GPC-150C, manufactured by Waters Corporation).

The number average molecular weight and the weight average molecular weight of the toner of the present disclosure was measured by using a column (KF801 to 807, manufactured by SHOWA DENKO K.K) according to the following method: The column was stabilized in a heat chamber at 40° C. and tetrahydrofuran was flown as solvent at 1 mL/min in the column at this temperature. Thereafter, 0.05 g of a sample was sufficiently dissolved in 5 g of THF followed by filtration by a filter as preprocessing (Chromatodisc having hole diameter of 0.45 μm, manufactured by Kurabo Industries Ltd.). In the end, the filtrate was adjusted in such a manner that the sample concentration was from 0.05% by weight to 0.6% by weight and 50 μL to 200 μL of the THF sample solution was infused for measuring. As to the weight average molecular weight Mw and the number average molecular weight Mn of the THF solution of the sample, the molecular weight distribution of the sample was calculated by the relation between the logarithm values of the standard curves made from several kinds of the monodispersed polystyrene standard samples and the count values.

As the standard polystyrene sample for the standard curve, at least about ten standard polystyrene samples among, for example, a polystyrene sample having a molecular weight of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, or $4.48\times10^6$, manufactured by Pressure Chemical Co. or TOSOH CORPORATION were used. A refractive index (RI) detector is used as the detector.

Measuring of Acid Value of Toner and Binder Resin

The acid value of the toner and the binder resin described below were measured by the measuring method according to JIS K0070-1992 under the following conditions.

Sample preparation: 0.5 g of the toner or the binder resin (0.3 g as portion soluble in the ethyl acetate) was added to 120 ml of toluene and dissolved therein while being stirred at room temperature (23° C.) for about 10 hours. 30 ml of ethanol was added to obtain a sample solution.

The acid value was calculated using the following measuring device and measuring conditions.

Measuring device: automatic potentiometric titrator DL-53 Titrator, manufactured by Mettler Toledo International Inc.
Electrode: DG113-SC, manufactured by Mettler Toledo International Inc.
Analyzing software: LabX Light Version 1.00.000
Calibration of device: Using a liquid solvent of 120 ml of toluene and 30 ml of ethanol
Measuring Temperature: 23° C.
The measuring conditions are as follows.
Stirring condition:
Stirring speed (%): 25
Stirring time (s): 15
Equilibrium titration condition:
Volumetric solution: $CH_3ONa$
Concentration (mol/L): 0.1
Electrode: DG 115
Measuring unit: mV
Titration of volumetric solution prior to measuring
Titer (mL): 1.0
Waiting time (s): 0
Titration mode of volumetric solution: Dynamic
dE (set) [mV]: 8.0
dV (min) [mL]: 0.03
dV (max) [mL]: 0.5
Measuring mode: equilibrium titration
dE [mV]: 0.5
dt [s]: 1.0
t (min) [s]: 2.0
t (max) [s]: 20.0
Recognition condition
Threshold: 100.0
Only maximum change rate: No
Range: No
Frequency: None
Measuring complete condition:
Maximum titer (mL): 10.0
Voltage: No
Gradient: No
After equivalent point: Yes
n number: 1
Combination of complete conditions: No
Evaluation condition
Procedure: Standard
Voltage 1: No
Voltage 2: No
Stop for re-evaluation: No Specific calculation was as follows: Titration was conducted using preliminarily set alcohol solution of N/10 potassium hydroxide and the acid value was obtained by the following relation based on the consumption amount of the alcohol solution of potassium:

Acid value: KOH (ml number)×N×56.1/sample mass
(N represents a factor of N/10KOH)

Since only one kind of binder resin was used in the following Examples and Comparative Examples, the acid values of the binder resin and the toner almost matched. Therefore, the acid value of the binder resin was treated as the acid value of the toner.

Manufacturing Example of Transparent Toner 1

| | |
|---|---|
| Polyester resin 1 (Mw: 7,200, Mn: 2,400, Acid value: 12 mgKOH/g): | 93 parts |
| Monoester wax 1 (mp: 70.5° C.): | 6 parts |
| Salicylic acid derivative zirconium salt: | 1 part |

The compound represented by the following chemical formula 1 was used as the salicylic acid derivative zirconium salt.

Chemical Formula 1

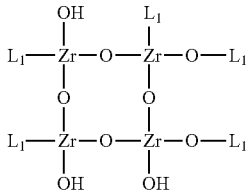

In the chemical formula, L1 represents the following chemical formula:

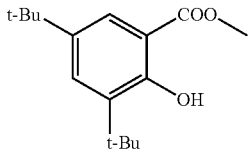

The toner material was preliminarily mixed by a HENSCHEL MIXER (FM20B, manufactured by NIPPON COKE & ENGINEERING CO., LTD.) and thereafter, melt-kneaded at from 100° C. to 130° C. by a one-shaft kneader (Ko-Kneader, available from BUSS).

The thus-obtained obtained kneaded material was cool down to room temperature followed by coarse-pulverization to 200 μm to 300 μm by a Rotoplex. Thereafter, using a counter jet mill (100AFG, manufactured by Hosokawa Micron Corporation), the coarsely-pulverized material was finely-pulverized while adjusting pulverization air pressure in such a manner that the weight average molecular weight was within the range of from 5.9 μm to 6.5 μm. While adjusting the louver aperture, the resultant was classified by an air classifier (EJ-LABO, manufactured by MATSUBO Corporation) in such a manner that the weight average molecular weight was from 6.8 μm to 7.2 μm and the ratio of the weight average molecular weight to the number average particle diameter was 1.20 or less to obtain mother toner particles. Then, 1.0 part of an additive (HDK-2000, manufactured by Clariant (Japan) K.K.) and 1.0 part of an additive (H05TD, manufactured by Clariant (Japan) K.K.) were stirred and mixed to 100 parts of the mother toner particles to manufacture transparent 1 having an MW of 7,100 and an Mn of 2,400.

Manufacturing Example of Transparent Toner 2

| | |
|---|---|
| Polyester resin 2 (Mw: 8,100, Mn: 2,500, Acid value: 12 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 2 having an Mw of 8,000 and an Mn of 2,500 was manufactured in the same manner as the transparent toner 1 except that the recipe specified above was used instead.

Manufacturing Example of Transparent Toner 3

| | |
|---|---|
| Polyester resin 3 (Mw: 10,000, Mn: 2,800, Acid value: 12 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 3 having an Mw of 9,900 and an Mn of 2,800 was manufactured in the same manner as the transparent toner 1 except that the recipe specified above was used instead.

Manufacturing Example of Transparent Toner 4

| | |
|---|---|
| Polyester resin 4 (Mw: 8,000, Mn: 2,400, Acid value: 6 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 4 having an Mw of 8,100 and an Mn of 2,400 was manufactured in the same manner as transparent toner 1 except that the recipe specified above was used instead.

Manufacturing Example of Transparent Toner 5

| | |
|---|---|
| Polyester resin 2 (Mw: 8,100, Mn: 2,500, Acid value: 12 mgKOH/g): | 95 parts |
| Monoester wax 1 (mp: 70.5° C.): | 4 parts |
| Salicylic acid derivative aluminum salt: | 1 part |

The compound represented by the following chemical formula 2 was used as the salicylic acid derivative aluminum salt.

Chemical formula 2

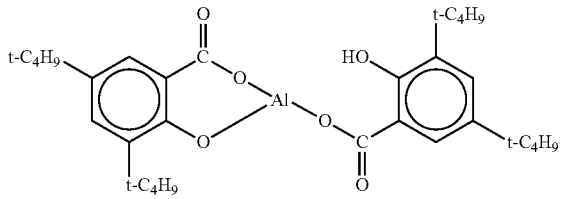

Transparent toner 5 having an Mw of 8,000 and an Mn of 2,500 was manufactured in the same manner as the transparent toner 1 except that the recipe specified above was used instead.

Manufacturing Example of Transparent Toner 6

| | |
|---|---|
| Polyester resin 2 (Mw: 8,100, Mn: 2,500, Acid value: 12 mgKOH/g): | 91 parts |
| Monoester wax 1 (mp: 70.5° C.): | 8 parts |
| Salicylic acid derivative aluminum salt (represented by chemical formula 2): | 1 part |

Transparent toner 6 having an Mw of 8,000 and an Mn of 2,500 was manufactured in the same manner as the transparent toner 1 except that the recipe specified above was used instead.

Manufacturing Example of Transparent Toner 7

| | |
|---|---|
| Polyester resin 2 (Mw: 8,100, Mn: 2,500, Acid value: 12 mgKOH/g): | 93.5 parts |
| Monoester wax 2 (mp: 64.2° C.): | 6 parts |
| Salicylic acid derivative zirconium salt (represented by chemical formula 1): | 0.5 parts |

Transparent toner 7 having an Mw of 8,000 and an Mn of 2,500 was manufactured in the same manner as the transparent toner 1 except that the recipe specified above was used instead.

Manufacturing Example of Transparent Toner 8

| | |
|---|---|
| Polyester resin 2 (Mw: 8,100, Mn: 2,500, Acid value: 12 mgKOH/g): | 92 parts |
| Monoester wax 1 (mp: 70.5° C.): | 6 parts |
| Salicylic acid derivative zirconium salt (represented by chemical formula 1): | 2 parts |

Transparent toner 8 having an Mw of 8,000 and an Mn of 2,500 was manufactured in the same manner as the transparent toner 1 except that the recipe specified above was used instead.

Manufacturing Example of Transparent Toner 9

| | |
|---|---|
| Polyester resin 2 (Mw: 8,100, Mn: 2,500, Acid value: 12 mgKOH/g): | 90 parts |
| Monoester wax 1 (mp: 70.5° C.): | 6 parts |
| Salicylic acid derivative zirconium salt (represented by chemical formula 1): | 1 part |
| Copolymer of acrylonitrile-butyl acrylate-styrene: | 3 parts |

Transparent toner 9 having an Mw of 8,000 and an Mn of 2,500 was manufactured in the same manner as the transparent toner 1 except that the recipe specified above was used instead.

Manufacturing Example of Transparent Toner 10

| | |
|---|---|
| Polyester resin 2 (Mw: 8,100, Mn: 2,500, Acid value: 12 mgKOH/g): | 88 parts |
| Monoester wax 1 (mp: 70.5° C.): | 6 parts |
| Salicylic acid derivative zirconium salt (represented by chemical formula 1): | 1 parts |
| Copolymer of acrylonitrile-butyl acrylate-styrene: | 5 parts |

Transparent toner 10 having an Mw of 8,000 and an Mn of 2,500 was manufactured in the same manner as the transparent toner 1 except that the recipe specified above was used instead.

Manufacturing Example of Transparent Toner 11

| | |
|---|---|
| Polyester resin 2 (Mw: 8,100, Mn: 2,500, Acid value: 12 mgKOH/g): | 86 parts |
| Monoester wax 1 (mp: 70.5° C.): | 6 parts |
| Salicylic acid derivative zirconium salt (represented by chemical formula 1): | 1 part |
| Copolymer of acrylonitrile-butyl acrylate-styrene: | 7 parts |

Transparent toner 11 having an Mw of 8,000 and an Mn of 2,500 was manufactured in the same manner as the transparent toner 1 except that the recipe specified above was used instead.

Manufacturing Example of Transparent Toner 12

| | |
|---|---|
| Polyester resin 2 (Mw: 8,100, Mn: 2,500, Acid value: 12 mgKOH/g): | 88 parts |
| Monoester wax 1 (mp: 70.5° C.): | 6 parts |
| Salicylic acid derivative zirconium salt (represented by chemical formula 1): | 1 part |
| Copolymer of acrylonitrile-adduct of butyl acrylate with polyethylene-styrene: | 5 parts |

Transparent toner 12 having an Mw of 8,000 and an Mn of 2,500 was manufactured in the same manner as the transparent toner 1 except that the recipe specified above was used instead.

Method of Manufacturing Master Batch 50 parts of carbon black (Regal 400 R, manufactured by Cabot Corporation), 50 parts of polyester resin 2 (Mw: 8,100, Mn: 2,500, acid value: 12 mgKOH/g), and 30 parts of water admixed by a HENSCHEL MIXER (NIPPON COKE & ENGINEERING CO., LTD.). The mixture was kneaded at 160° C. for 50 minutes using two rolls. Subsequent to rolling and cooling, the resultant was pulverized by a pulverizer to obtain a black master batch. In addition, magenta master batch, cyan master batch, and yellow master batch were manufactured in the same manner as the black master batch except that C.I. Pigment Red 26, C.I. Pigment Blue 15:3, and C.I. Pigment Yellow 155 were used instead of carbon black, respectively.

Manufacturing Example of Black Toner

| | |
|---|---|
| Polyester resin 2 (Mw: 8,100, Mn: 2,500, Acid value: 12 mgKOH/g): | 72 parts |
| Monoester wax 1 (mp: 70.5° C.): | 6 parts |
| Salicylic acid derivative zirconium salt (represented by chemical formula 1): | 1 part |
| Copolymer of acrylonitrile-butyl acrylate-styrene: | 5 parts |
| Black master batch: | 16 parts |

Black toner having an Mw of 8,000 and an Mn of 2,500 was manufactured in the same manner as the transparent toner 1 except that the toner recipe specified above was used instead.

Manufacturing Example of Magenta Toner

| | |
|---|---|
| Polyester resin 2 (Mw: 8,100, Mn: 2,500, Acid value: 12 mgKOH/g): | 72 parts |
| Monoester wax 1 (mp: 70.5° C.): | 6 parts |
| Salicylic acid derivative zirconium salt (represented by chemical formula 1): | 1 part |
| Copolymer of acrylonitrile-butyl acrylate-styrene: | 5 parts |
| Magenta master batch: | 16 parts |

Magenta toner having an Mw of 8,000 and an Mn of 2,500 was manufactured in the same manner as the transparent toner 1 except that the toner recipe specified above was used instead.

Manufacturing Example of Cyan Toner

| | |
|---|---|
| Polyester resin 2 (Mw: 8,100, Mn: 2,500, Acid value: 12 mgKOH/g): | 72 parts |
| Monoester wax 1 (mp: 70.5° C.): | 6 parts |
| Salicylic acid derivative zirconium salt (represented by chemical formula 1): | 1 parts |
| Copolymer of acrylonitrile-butyl acrylate-styrene: | 5 parts |
| Cyan master batch: | 16 parts |

Cyan toner having an Mw of 8,000 and an Mn of 2,500 was manufactured in the same manner as the transparent toner 1 except that the toner recipe specified above was used instead.

Manufacturing Example of Yellow Toner

| | |
|---|---|
| Polyester resin 2 (Mw: 8,100, Mn: 2,500, Acid value: 12 mgKOH/g): | 72 parts |
| Monoester wax 1 (mp: 70.5° C.): | 6 parts |
| Salicylic acid derivative zirconium salt (represented by chemical formula 1): | 1 part |
| Copolymer of acrylonitrile-butyl acrylate-styrene: | 5 parts |
| Yellow master batch: | 16 parts |

Yellow toner having an Mw of 8,000 and an Mn of 2,500 was manufactured in the same manner as the transparent toner 1 except that the toner recipe specified above was used instead.

Manufacturing Example of Transparent Toner 13

| | |
|---|---|
| Polyester resin 5 (Mw: 6,400, Mn: 2,300, Acid value: 12 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 13 having an Mw of 6,500 and an Mn of 2,300 was manufactured in the same manner as transparent toner 1 except that the recipe specified above was used instead.

Manufacturing Example of Transparent Toner 14

| | |
|---|---|
| Polyester resin 6 (Mw: 11,000, Mn: 2,800, Acid value: 12 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 14 having an Mw of 11,500 and an Mn of 2,800 was manufactured in the same manner as transparent toner 1 except that the recipe specified above was used instead.

Manufacturing Example of Transparent Toner 15

| | |
|---|---|
| Polyester resin 8 (Mw: 7,800, Mn: 2,400, Acid value: 4 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 15 having an Mw of 7,900 and an Mn of 2,400 was manufactured in the same manner as the transparent toner 1 except that the recipe specified above was used instead.

Manufacturing Example of Transparent Toner 16

| | |
|---|---|
| Polyester resin 7 (Mw: 8,200, Mn: 2,400, Acid value: 14 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 16 having an Mw of 8,200 and an Mn of 2,400 was manufactured in the same manner as transparent toner 1 except that the recipe specified above was used instead.

Manufacturing Example of Transparent Toner 17

| | |
|---|---|
| Polyol resin (Mw: 8,000, Mn: 2,500, Acid value: 20 mgKOH/g): | 93 parts |
| Monoester wax 1 (mp: 70.5° C.): | 6 parts |
| Salicylic acid derivative zirconium salt (represented by chemical formula 1): | 1 part |

Transparent toner 17 having an Mw of 7,900 and an Mn of 2,500 was manufactured in the same manner as the transparent toner 1 except that the recipe specified above was used instead.

Manufacturing Example of Transparent Toner 18

| | |
|---|---|
| Polyester resin 2 (Mw: 8,100, Mn: 2,500, Acid value: 12 mgKOH/g): | 93 parts |
| Carnauba wax (mp: 80.0° C.): | 6 parts |
| Salicylic acid derivative zirconium salt (represented by chemical formula 1): | 1 part |

Transparent toner 18 having an Mw of 8,000 and an Mn of 2,500 was manufactured in the same manner as the transparent toner 1 except that the recipe specified above was used instead.

Manufacturing Example of Transparent Toner 19

| | |
|---|---|
| Polyester resin 2 (Mw: 8,100, Mn: 2,500, Acid value: 12 mgKOH/g): | 93 parts |
| Microcrystalline wax (mp: 87.0° C.): | 6 parts |
| Salicylic acid derivative zirconium salt (represented by chemical formula 1): | 1 part |

Transparent toner 19 having an Mw of 8,000 and an Mn of 2,500 was manufactured in the same manner as the transparent toner 1 except that the recipe specified above was used instead.

Manufacturing Example of Transparent Toner 20

| | |
|---|---|
| Polyester resin 2 (Mw: 8,100, Mn: 2,500, Acid value: 12 mgKOH/g): | 93 parts |
| Monoester wax 1 (mp: 70.5° C.): | 6 parts |
| Salicylic acid derivative zinc salt: | 1 part |

The compound represented by the following chemical formula 3 was used as the salicylic acid derivative zinc salt.

Chemical Formula 3

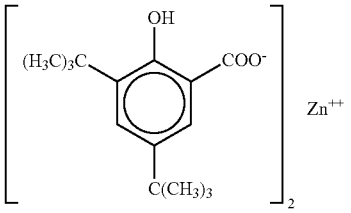

Transparent toner 20 having an Mw of 8,000 and an Mn of 2,500 was manufactured in the same manner as transparent toner 1 except that the toner recipe specified above was used instead.

Manufacturing Example of Transparent Toner 21

| | |
|---|---|
| Polyester resin 2 (Mw: 8,100, Mn: 2,500, Acid value: 12 mgKOH/g): | 94 parts |
| Monoester wax 1 (mp: 70.5° C.): | 6 parts |

Transparent toner 21 having an Mw of 8,000 and an Mn of 2,500 was manufactured in the same manner as the transparent toner 1 except that the recipe specified above was used instead.

Mw, Mn and the raw materials of the toner are shown in Table 1.

TABLE 1

| Toner | | | Binder resin | | | | |
|---|---|---|---|---|---|---|---|
| | | | | | | Acid | |
| Toner Kind | Mw | Mn | Kind | Mw | Mn | value | Content |
| Transparent toner 1 | 7,100 | 2,400 | Polyester resin 1 | 7,200 | 2,400 | 12 | 93 |
| Transparent toner 2 | 8,000 | 2,500 | Polyester resin 2 | 8,100 | 2,500 | 12 | 93 |
| Transparent toner 3 | 9,900 | 2,800 | Polyester resin 3 | 10,000 | 2,800 | 12 | 93 |
| Transparent toner 4 | 8,100 | 2,400 | Polyester resin 4 | 8,000 | 2,400 | 6 | 93 |
| Transparent toner 5 | 8,000 | 2,500 | Polyester resin 2 | 8,100 | 2,500 | 12 | 95 |
| Transparent toner 6 | 8,000 | 2,500 | Polyester resin 2 | 8,100 | 2,500 | 12 | 91 |
| Transparent toner 7 | 8,000 | 2,500 | Polyester resin 2 | 8,100 | 2,500 | 12 | 93.5 |
| Transparent toner 8 | 8,000 | 2,500 | Polyester resin 2 | 8,100 | 2,500 | 12 | 92 |
| Transparent toner 9 | 8,000 | 2,500 | Polyester resin 2 | 8,100 | 2,500 | 12 | 90 |
| Transparent toner 10 | 8,000 | 2,500 | Polyester resin 2 | 8,100 | 2,500 | 12 | 88 |
| Transparent toner 11 | 8,000 | 2,500 | Polyester resin 2 | 8,100 | 2,500 | 12 | 86 |
| Transparent toner 12 | 8,000 | 2,500 | Polyester resin 2 | 8,100 | 2,500 | 12 | 88 |
| Black toner | 8,000 | 2,500 | Polyester resin 2 | 8,100 | 2,500 | 12 | 72 |
| Magenta toner | 8,000 | 2,500 | Polyester resin 2 | 8,100 | 2,500 | 12 | 72 |
| Cyan toner | 8,000 | 2,500 | Polyester resin 2 | 8,100 | 2,500 | 12 | 72 |
| Yellow toner | 8,000 | 2,500 | Polyester resin 2 | 8,100 | 2,500 | 12 | 72 |
| Transparent toner 13 | 6,500 | 2,300 | Polyester resin 5 | 6,400 | 2,300 | 12 | 93 |
| Transparent toner 14 | 11,500 | 2,800 | Polyester resin 6 | 11,000 | 2,800 | 12 | 93 |
| Transparent toner 15 | 7,900 | 2,400 | Polyester resin 8 | 7,800 | 2,400 | 4 | 93 |
| Transparent toner 16 | 8,200 | 2,400 | Polyester resin 7 | 8,200 | 2,400 | 14 | 93 |
| Transparent toner 17 | 7,900 | 2,500 | Polyol resin | 8,000 | 2,500 | 20 | 93 |
| Transparent toner 18 | 8,000 | 2,500 | Polyester resin 2 | 8,100 | 2,500 | 12 | 93 |
| Transparent toner 19 | 8,000 | 2,500 | Polyester resin 2 | 8,100 | 2,500 | 12 | 93 |
| Transparent toner 20 | 8,000 | 2,500 | Polyester resin 2 | 8,100 | 2,500 | 12 | 93 |
| Transparent toner 21 | 8,000 | 2,500 | Polyester resin 2 | 8,100 | 2,500 | 12 | 94 |

TABLE 1-continued

| Wax | | | Tri- or higher metal salt | | Dispersant | |
|---|---|---|---|---|---|---|
| Kind | Melting point (° C.) | Content | Kind | Content | Kind | Content |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Monoester wax 1 | 70.5 | 4 | Salicylic acid derivative aluminum salt | 1 | — | — |
| Monoester wax 1 | 70.5 | 8 | Salicylic acid derivative aluminum salt | 1 | — | — |
| Monoester wax 2 | 64.2 | 6 | Salic1lic acid 1erivative z1rconium salt | 0.5 | — | — |
| Monoester wax 1 | 70.5 | 6 | Salicylic acid derivative zirconium salt | 2 | — | — |
| Monoester wax 1 | 70.5 | 6 | Salicylic acid derivative zirconium salt | 1 | Copolymer of acrylonitrile-butyl acrylate-styrene | 3 |
| Monoester wax 1 | 70.5 | 6 | Salicylic acid derivative zirconium salt | 1 | Copolymer of acrylonitrile-butyl acrylate-styrene | 5 |
| Monoester wax 1 | 70.5 | 6 | Salicylic acid derivative zirconium salt | 1 | Copolymer of acrylonitrile-butyl acrylate-styrene | 7 |
| Monoester wax 1 | 70.5 | 6 | Salicylic acid derivative zirconium salt | 1 | Copolymer of acrylonitrile-adduct of butyl acrylate with polyethylene-styrene | 5 |
| Monoester wax 1 | 70.5 | 6 | Salicylic acid derivative zirconium salt | 1 | Copolymer of acrylonitrile-butyl acrylate-styrene | 5 |
| Monoester wax 1 | 70.5 | 6 | Salicylic acid derivative zirconium salt | 1 | Copolymer of acrylonitrile-butyl acrylate-styrene | 5 |

TABLE 1-continued

| | | | | | | |
|---|---|---|---|---|---|---|
| Monoester wax 1 | 70.5 | 6 | Salicylic acid derivative zirconium salt | 1 | Copolymer of acrylonitrile-butyl acrylate-styrene | 5 |
| Monoester wax 1 | 70.5 | 6 | Salicylic acid derivative zirconium salt | 1 | Copolymer of acrylonitrile-butyl acrylate-styrene | 5 |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Monoester wax 1 | 70.5 | 6 | Salicylic acid derivative zirconium salt | 1 | — | — |
| Carnauba wax | 80 | 6 | Salicylic acid derivative zirconium salt | 1 | — | — |
| Micro-crystalline wax | 87 | 6 | Salicylic acid derivative zirconium salt | 1 | — | — |
| Monoester wax 1 | 70.5 | 6 | Salicylic acid derivative zinc salt | 1 | — | — |
| Monoester wax 1 | 70.5 | 6 | — | 0 | — | — |

Manufacturing Example of Two Component Development Agent

Manufacturing of Carrier

| | |
|---|---|
| Silicone resin (Organo straight silicone): | 100 parts |
| Toluene: | 100 parts |
| γ-(2-aminoethyl) aminopropyl trimethoxy silane: | 5 parts |
| Carbon Black: | 10 parts |

The mixture specified above was dispersed by a Homomixer for 20 minutes to prepare a liquid for forming a covering layer. This liquid for forming a covering layer was applied to Mn ferrite having a weight average molecular weight of 35 μm as core material by a fluid bed type coating device while controlling the temperature in the fluid bed tank at 70° C. followed by drying in such a manner that the average layer thickness on the surface of the core material is 0.20 μm. The thus-obtained carrier was baked in an electric furnace at 180° C. for two hours to obtain Carrier A.

Two component development agents using the transparent toners 1 to 21, the black toner, the magenta toner, the cyan toner, and the yellow toner were manufactured as described below for evaluation.

Manufacturing of Two Component Development Agent

The manufactured transparent toner, the color toner, and Carrier A were uniformly mixed and charged by a TURBULA® mixer (manufactured by Willy A. Bachofen AG) at 48 rpm for five minutes to manufacture each two-component development agent. he mixing ratio of the toner and the carrier was adjusted to the toner concentration of 4% by weight of initial development agent in a machine for evaluation.

Gloss

Using an image forming apparatus remodeled based on a digital full color image forming apparatus (Imagio Neo C600, manufactured by Ricoh Co., Ltd.) with the development agent regulating blade 10, a square solid image of 4 cm×4 cm was formed with each development agent at a linear speed of 280 mm/s in such a manner that the attachment amount of the toner was 0.65 mg/cm$^2$ and fixed at a fixing temperature of 200° C. with a nipping width of 10 mm. Thereafter, the image gloss of the fixed image was measured.

The recording medium for this evaluation was COTED glossy (135*g/m*$^2$, manufactured by Mondi). The 60 degree gloss of the image was measured and evaluated at 10 points by using a glossmeter (VGS-1D, manufactured by NIPPON DENSHOKU INDUSTRIES Co., LTD.).

Evaluation Criteria

A: 85 or higher

B: 80 to less than 85

C: 75 to less than 80

D: Less than 75

Gloss Width

Using an image forming apparatus remodeled based on a digital full color image forming apparatus (Imagio Neo C600, manufactured by Ricoh Co., Ltd.) with the development agent regulating blade 10, a square solid image of 4 cm×4 cm was formed with each development agent at a linear speed of 280 mm/s in such a manner that the attachment amount of the toner was 0.65 mg/cm$^2$ and fixed at a fixing temperature of from 180° C. to 220° C. with a nipping width of 10 mm. Thereafter, the image gloss of the fixed image was measured.

The recording medium for this evaluation was COTED glossy (135*g/m*$^2$, manufactured by Mondi). The 60 degree gloss of the image was measured and evaluated at 10 points by using a glossmeter (VSG-1D, manufactured by NIPPON DENSHOKU INDUSTRIES Co., LTD.). The temperature range having a value of 75 or greater was evaluated.

Evaluation Criteria

A: 25° C. or higher

B: 20° C. to lower than 25° C.

C: 15° C. to lower than 20° C.

D: Lower than 15° C.

Low Temperature Fixability

Using an image forming apparatus remodeled based on a digital full color image forming apparatus (Imagio Neo C600, manufactured by Ricoh Co., Ltd.) with the development agent regulating blade 10, a square solid image of 4 cm×4 cm was formed with each development agent at a linear speed of 280 mm/s in such a manner that the attachment amount of the toner was 0.85 mg/cm2 and fixed with a nipping width of 10 mm while changing the fixing roller temperature. Cold offset was visually evaluated. The lowest temperature below which cold offset occurred was defined as lowest fixing temperature. Thereafter, the low temperature fixability of the toner was evaluated according to the following criteria:

The recording medium for use in this evaluation was PPC TYPE6000 (70W) (manufactured by Ricoh Co., Ltd.).

Evaluation Criteria

A: The lowest fixing temperature was lower than 140° C.

B: The lowest fixing temperature was from 140° C. to lower than 145° C.

C: The lowest fixing temperature was from 145° C. to lower than 150° C.

D: The lowest fixing temperature was 150° C. or higher

Hot Offset Resistance

Using an image forming apparatus remodeled based on a digital full color image forming apparatus (Imagio Neo C600, manufactured by Ricoh Co., Ltd.) with the development agent regulating blade 10, a square solid image of 4 cm×4 cm was formed with each development agent at a linear speed of 280 mm/s in such a manner that the attachment amount of the toner was 0.85 mg/cm$^2$. Thereafter, cold offset was visually evaluated for the image, which was fixed with a nipping width of 10 mm while changing the fixing roller temperature. The highest temperature above which hot offset occurred was determined as the highest fixing temperature and hot offset resistance was evaluated according to the following criteria.

The recording medium for use in this evaluation was PPC TYPE6000 (70W) (manufactured by Ricoh Co., Ltd.).

Evaluation Criteria

A: The highest fixing temperature was 185° C. or higher

B: The highest fixing temperature was from 175° C. to lower than 185° C.

C: The highest fixing temperature was from 170° C. to lower than 175° C.

D: The highest fixing temperature was lower than 170° C.

High Temperature Stability

High temperature stability was measured using a penetrometer (manufactured by Nikka Engineering Co., Ltd.).

Specifically, 10 g of toner was weighed and placed in a glass container (30 ml screw vial) in an environment of 20° C. to 25° C. and 40% to 60% RH. The lid of the container was closed. After tapping the glass container containing the toner 100 times, the glass container was left in a constant tank set at 50° C. for 24 hours. Thereafter, the penetration degree of the toner was measured by the penetrometer and the high temperature stability thereof was evaluated according to the evaluation criteria.

The larger the penetration degree value, the more excellent the high temperature stability.

Evaluation Criteria

A: Penetration degree was 30 mm or more

B: Penetration degree was 25 mm to less than 30 mm

C: Penetration degree was 20 mm to less than 25 mm

D: Penetration degree was less than 20 mm

Filming Property

Each development agent was set in an image forming apparatus remodeled based on a digital full color image forming apparatus (Imagio Neo C600, manufactured by Ricoh Co., Ltd.) with the development agent regulating blade 10 and images were continuously printed on PPC TYPE6000 (70W) (manufactured by Ricoh Co., Ltd.) at a linear speed of 280 mm/s with an image occupying ratio of 7%. Whether or not filming occurred to a photoreceptor or defective images (half tone uneven image density) ascribable to filming were printed was checked after printing 20,000 sheet, 50,000 sheet, and 100,000 sheets. Filming tends to occur as the number of printed sheets increases.

Evaluation Criteria

A: No filming at 100,000 sheets

B: Filming observed at 50,000th sheet

Uneven Gloss

Using an image forming apparatus remodeled based on a digital full color image forming apparatus (Imagio Neo C600, manufactured by Ricoh Co., Ltd.) with the development agent regulating blade 10, a square solid image of 4 cm×4 cm was formed with each development agent at a linear speed of 280 mm/s in such a manner that the attachment amount of the toner was 0.65 mg/cm$^2$ and fixed at a fixing temperature of 200° C. with a nipping width of 10 mm. Thereafter, the uneven image gloss degree of the output image was visually confirmed and rated as initial uneven image gloss. In addition, after printing images continuously with a run length of 50,000 sheets, the uneven gloss degree of the last output image was visually confirmed and rated as the uneven gloss after printing.

The recording medium for this evaluation was COTED glossy (135 g/m$^2$, manufactured by Mondi).

Evaluation Criteria

A: No uneven image gloss confirmed

B: Slight even image gloss confirmed without causing a practical problem

C: Uneven image gloss confirmed without causing a practical problem

D: Uneven image gloss extremely noticeable above acceptable range

Example 1

The transparent toner 1 was used and evaluated using the development unit employing the configuration of the regulating blade 10 in the embodiment described above as illustrated in FIG. 11.

Example 2

The transparent toner 2 was used instead of the transparent toner 1 and evaluated in the same manner as in Example 1.

Example 3

Transparent toner 3 was used instead of the transparent toner 1 and evaluated in the same manner as in Example 1.

Example 4

The transparent toner 4 was used instead of the transparent toner 1 and evaluated in the same manner as in Example 1.

Example 5

The transparent toner 5 was used instead of the transparent toner 1 and evaluated in the same manner as in Example 1.

Example 6

The transparent toner 6 was used instead of the transparent toner 1 and evaluated in the same manner as in Example 1.

Example 7

The transparent toner 7 was used instead of the transparent toner 1 and evaluated in the same manner as in Example 1.

Example 8

The transparent toner 8 was used instead of the transparent toner 1 and evaluated in the same manner as in Example 1.

Example 9

The transparent toner 9 was used instead of the transparent toner 1 and evaluated in the same manner as in Example 1.

Example 10

The transparent toner 10 was used instead of the transparent toner 1 and evaluated in the same manner as in Example 1.

Example 11

The transparent toner 11 was used instead of the transparent toner 1 and evaluated in the same manner as in Example 1.

Example 12

The transparent toner 12 was used instead of the transparent toner 1 and evaluated in the same manner as in Example 1.

Example 13

The black toner was used instead of the transparent toner 1 and evaluated in the same manner as in Example 1.

Example 14

The magenta toner was used instead of the transparent toner 1 and evaluated in the same manner as in Example 1.

Example 15

The cyan toner was used instead of the transparent toner 1 and evaluated in the same manner as in Example 1.

Example 16

The yellow toner was used instead of the transparent toner 1 and evaluated in the same manner as in Example 1.

Comparative Example 1

The transparent toner 13 was used instead of the transparent toner 1 and evaluated in the same manner as in Example 1.

Comparative Example 2

The transparent toner 14 was used instead of the transparent toner 1 and evaluated in the same manner as in Example 1.

Comparative Example 3

The transparent toner 15 was used instead of the transparent toner 1 and evaluated in the same manner as in Example 1.

Comparative Example 4

The transparent toner 16 was used instead of the transparent toner 1 and evaluated in the same manner as in Example 1.

Comparative Example 5

The transparent toner 17 was used instead of the transparent toner 1 and evaluated in the same manner as in Example 1.

Comparative Example 6

The transparent toner 18 was used instead of the transparent toner 1 and evaluated in the same manner as in Example 1.

Comparative Example 7

The transparent toner 19 was used instead of the transparent toner 1 and evaluated in the same manner as in Example 1.

Comparative Example 8

The transparent toner 20 was used instead of the transparent toner 1 and evaluated in the same manner as in Example 1.

Comparative Example 9

The transparent toner 21 was used instead of the transparent toner 1 and evaluated in the same manner as in Example 1.

Comparative Example 10

Figure 13:
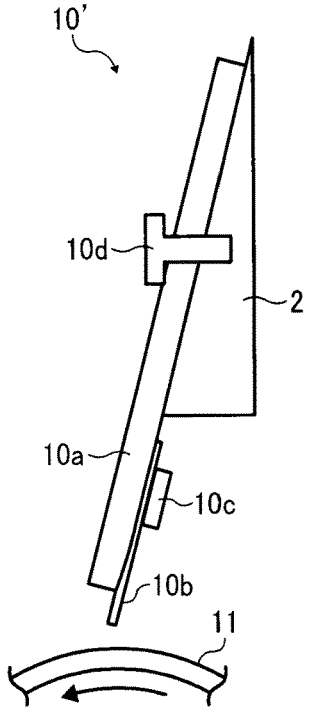
FIG. 13 is a diagram illustrating a schematic structure of a regulating blade for use in Comparative Examples in an effect confirmation test, shown as a cross section viewed from a direction perpendicular to the rotation axis of the development sleeve.

Transparent toner 2 was used and evaluated using the development unit employing the configuration of a regulating blade 10' illustrated in FIG. 13.

Figure 14:
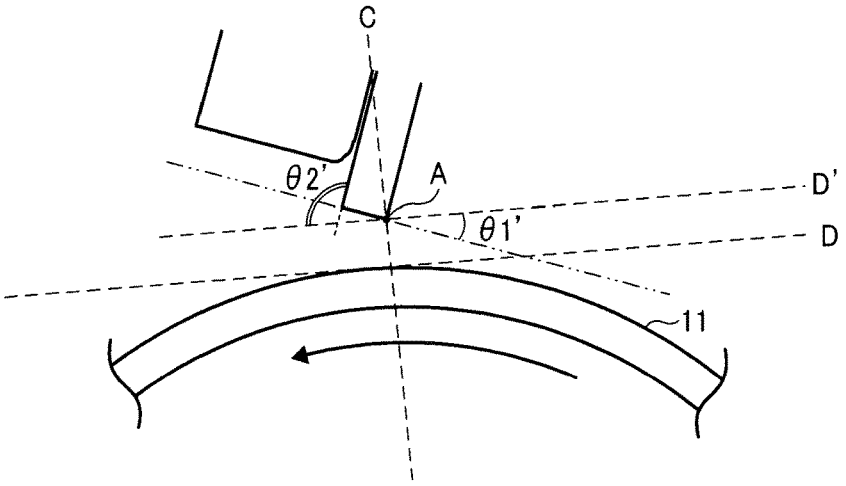
FIG. 14 is an enlarged view illustrating a facing area of the regulating blade and the development sleeve of Comparative Examples.

The regulating blade 10' was made by cutting the attached portion of the non-magnetic plate 10*a* to the development agent container 2 of the development unit, and the upstream end A (illustrated in FIG. 14) in the surface moving direction of the development sleeve of the end surface of the magnetic plate of the magnetic plate 10*b* is configured to be closest to the surface of the development sleeve 11 based on the regulating blade 10. Specifically, as illustrated in FIG. 14, an angle θ1' formed by the virtual line D' and the end surface of the magnetic plate 10*b* is less than 0° (angles counterclockwise relative to the virtual line D' in FIG. 12 are defined as plus) and set to be about −15°.

Comparative Example 11

Transparent toner 10 was used instead of the transparent toner 2 and evaluated in the same manner as in Comparative Example 10.

Comparative Example 12

The black toner was used instead of the transparent toner 2 and evaluated in the same manner as in Comparative Example 10.

The results are shown in Table 2.

TABLE 2

| | Toner | Regulating blade | Gloss | Gloss width | Low temperature fixability | Hot offset resistance |
|---|---|---|---|---|---|---|
| Example 1 | Transparent toner 1 | Regulating blade 10 | B | A | A | C |
| Example 2 | Transparent toner 2 | Regulating blade 10 | A | A | B | B |
| Example 3 | Transparent toner 3 | Regulating blade 10 | B | A | C | A |
| Example 4 | Transparent toner 4 | Regulating blade 10 | A | B | B | C |
| Example 5 | Transparent toner 5 | Regulating blade 10 | B | B | C | B |
| Example 6 | Transparent toner 6 | Regulating blade 10 | A | A | B | B |
| Example 7 | Transparent toner 7 | Regulating blade 10 | A | A | A | C |
| Example 8 | Transparent toner 8 | Regulating blade 10 | B | A | B | A |
| Example 9 | Transparent toner 9 | Regulating blade 10 | A | A | B | B |
| Example 10 | Transparent toner 10 | Regulating blade 10 | B | A | B | B |
| Example 11 | Transparent toner 11 | Regulating blade 10 | B | A | B | B |
| Example 12 | Transparent toner 12 | Regulating blade 10 | B | A | B | B |
| Example 13 | Black toner | Regulating blade 10 | C | C | B | B |
| Example 14 | Magenta toner | Regulating blade 10 | C | C | B | B |
| Example 15 | Cyan toner | Regulating blade 10 | C | C | B | B |
| Example 16 | Yellow toner | Regulating blade 10 | C | C | B | B |
| Comparative Example 1 | Transparent toner 13 | Regulating blade 10 | C | D | A | D |
| Comparative Example 2 | Transparent toner 14 | Regulating blade 10 | D | D | D | A |
| Comparative Example 3 | Transparent toner 15 | Regulating blade 10 | B | C | B | D |
| Comparative Example 4 | Transparent toner 16 | Regulating blade 10 | D | D | B | B |
| Comparative Example 5 | Transparent toner 17 | Regulating blade 10 | C | D | D | B |
| Comparative Example 6 | Transparent toner 18 | Regulating blade 10 | C | D | C | C |

TABLE 2-continued

| | | | | | | |
|---|---|---|---|---|---|---|
| Comparative Example 7 | Transparent toner 19 | Regulating blade 10 | C | D | D | A |
| Comparative Example 8 | Transparent toner 20 | Regulating blade 10 | B | C | B | D |
| Comparative Example 9 | Transparent toner 21 | Regulating blade 10 | B | C | B | D |
| Comparative Example 10 | Transparent toner 2 | Regulating blade 10' | A | A | B | B |
| Comparative Example 11 | Transparent toner 10 | Regulating blade 10' | B | A | B | B |
| Comparative Example 12 | Black toner | Regulating blade 10' | C | C | B | B |

| | Toner | Regulating blade | High temperature stability | Filming property | Initial uneven gloss | Uneven gloss after printing |
|---|---|---|---|---|---|---|
| Example 1 | Transparent toner 1 | Regulating blade 10 | C | C | A | B |
| Example 2 | Transparent toner 2 | Regulating blade 10 | C | C | A | A |
| Example 3 | Transparent toner 3 | Regulating blade 10 | B | C | A | A |
| Example 4 | Transparent toner 4 | Regulating blade 10 | C | C | A | A |
| Example 5 | Transparent toner 5 | Regulating blade 10 | B | B | A | B |
| Example 6 | Transparent toner 6 | Regulating blade 10 | C | C | A | C |
| Example 7 | Transparent toner 7 | Regulating blade 10 | C | C | A | C |
| Example 8 | Transparent toner 8 | Regulating blade 10 | C | C | A | A |
| Example 9 | Transparent toner 9 | Regulating blade 10 | A | B | A | A |
| Example 10 | Transparent toner 10 | Regulating blade 10 | A | B | A | A |
| Example 11 | Transparent toner 11 | Regulating blade 10 | A | B | A | A |
| Example 12 | Transparent toner 12 | Regulating blade 10 | B | B | A | A |
| Example 13 | Black toner | Regulating blade 10 | B | B | A | A |
| Example 14 | Magenta toner | Regulating blade 10 | B | B | A | A |
| Example 15 | Cyan toner | Regulating blade 10 | B | B | A | A |
| Example 16 | Yellow toner | Regulating blade 10 | B | B | A | A |
| Comparative Example 1 | Transparent toner 13 | Regulating blade 10 | D | C | A | C |
| Comparative Example 2 | Transparent toner 14 | Regulating blade 10 | B | C | A | A |
| Comparative Example 3 | Transparent toner 15 | Regulating blade 10 | C | C | A | A |
| Comparative Example 4 | Transparent toner 16 | Regulating blade 10 | C | C | A | A |
| Comparative Example 5 | Transparent toner 17 | Regulating blade 10 | C | C | A | B |
| Comparative Example 6 | Transparent toner 18 | Regulating blade 10 | C | B | A | C |
| Comparative Example 7 | Transparent toner 19 | Regulating blade 10 | D | C | A | C |
| Comparative Example 8 | Transparent toner 20 | Regulating blade 10 | C | C | A | B |
| Comparative Example 9 | Transparent toner 21 | Regulating blade 10 | C | C | A | B |
| Comparative Example 10 | Transparent toner 2 | Regulating blade 10' | C | C | A | D |
| Comparative Example 11 | Transparent toner 10 | Regulating blade 10' | A | B | A | D |
| Comparative Example 12 | Black toner | Regulating blade 10' | B | B | A | D |

Example 17

Images were formed using transparent toner 12 and black toner available on market (proper black toner for Imagio Neo C600, manufactured by Ricoh Co., Ltd.) by the image forming method 1 followed by fixing to obtain fixed images.

Example 18

Images were formed using transparent toner 12 and black toner available on market (proper black toner for Imagio Neo C600, manufactured by Ricoh Co., Ltd.) by the image forming method 2 followed by fixing to obtain fixed images.

Gloss

Using an image forming apparatus remodeled based on a digital full color image forming apparatus (Imagio Neo C600, manufactured by Ricoh Co., Ltd.) with the development agent regulating blade 10, a square solid image of 4 cm×4 cm of transparent toner was formed and overlapped on a square solid image of 4 cm×4 cm of black toner was formed with each development agent at a linear speed of 280 mm/s in such a manner that the attachment amount of the toner was 0.45 mg/cm$^2$ for each toner and fixed at a fixing temperature of 200° C. with a nipping width of 10 mm followed by measuring of gloss of the image. The image was formed on COTED glossy (135*g/m*$^2$, manufactured by Mondi). The 60 degree gloss of the image was measured and evaluated at 10 points by using a glossmeter (VSG-1D, manufactured by NIPPON DENSHOKU INDUSTRIES Co., LTD.).

Evaluation Criteria

A: 85 or higher

B: 80 to less than 85

C: 75 to less than 80

D: Less than 75

The results are shown in Table 3.

TABLE 3

| | Image forming method | Gloss of transparent toner image | Gloss of black toner image |
|---|---|---|---|
| Example 17 | 1 | B | D |
| Example 18 | 2 | B | D |

According to the present disclosure, a toner is provided which has excellent gloss According to the present disclosure, a toner is provided which has excellent gloss close to photograph gloss over a wide fixing temperature range, extremely excellent low temperature fixability, excellent hot offset resistance, and good storage stability.

Having now fully described embodiments of the present invention, it will be apparent to one of ordinary skill in the art that many changes and modifications can be made thereto without departing from the spirit and scope of embodiments of the invention as set forth herein.

What is claimed is:

1. A toner comprising:

a binder resin;

a releasing agent;

a tri- or higher metal salt, and a wax dispersing agent, wherein the wax dispersing agent is a copolymer resin comprising monomers of styrene, butyl acrylate, and acrylonitrile;

wherein the binder resin has a weight average molecular weight (Mw) of from 7,000 to 10,000, a ratio of the weight average molecular weight (Mw) to a number average molecular weight (Mn) of 5 or less, and an acid value of from 6 mgKOH/g to 12 mgKOH/g, wherein the binder resin is a polyester resin, wherein the releasing agent is a monoester wax, and wherein the toner comprises no colorant.

2. The toner according to claim 1, wherein the tri- or higher metal salt is salicylic acid derivative zirconium salt.

3. An image forming method comprising:

overlapping the toner of claim 1 on a color toner to form an image on a recording medium; and fixing the image on the recording medium.

4. An image forming method comprising:

regulating a transfer amount of a development agent comprising the toner of claim 1 and carrier on a development agent bearing member by a regulating member; and developing an image formed on an image bearing member with the toner of claim 1, wherein the regulating member comprises a magnetic plate and a non-magnetic plate, wherein the non-magnetic plate is arranged downstream of the magnetic plate in a transfer direction of the development agent, wherein an end surface of the magnetic plate protrudes closer to a surface of the development agent bearing member than an end surface of the non-magnetic surface, wherein a downstream end in the transfer direction of the development agent of the end surface of the magnetic plate approaches closest to the surface of the development agent bearing member for development.

5. A process cartridge comprises:

an image bearing member to bear a latent electrostatic image thereon; and a development device to render the latent electrostatic image visible with a development agent comprising the toner of claim 1 and carrier, wherein the process cartridge is detachably attachable to an image forming apparatus.

6. A printed matter comprising:

a recording medium; and an image formed thereon, wherein the image is formed by the image forming method of claim 3.

* * * * *